United States Patent [19]

Fujimoto et al.

[11] Patent Number: 4,769,313

[45] Date of Patent: Sep. 6, 1988

[54] IMAGE FORMING METHOD UTILIZING ACCELERATED DESILVERIZATION OF COLOR PHOTOGRAPHIC MATERIAL CONTAINING MAGNETA COUPLER

[75] Inventors: Hiroshi Fujimoto; Shinzo Kishimoto; Akira Abe; Junya Nakajima, all of Kanagawa, Japan

[73] Assignee: Fuji Photo Film Co., Ltd., Kanagawa, Japan

[21] Appl. No.: 933,517

[22] Filed: Nov. 21, 1986

[30] Foreign Application Priority Data

Nov. 22, 1985 [JP] Japan ..... 60-263366

[51] Int. Cl.[4] ..... G03C 7/00; G03C 5/44; G03C 5/24; G03C 7/32

[52] U.S. Cl. ..... 430/393; 430/381; 430/386; 430/387; 430/430; 430/446; 430/476; 430/548; 430/558

[58] Field of Search ..... 430/393, 558, 386, 387, 430/476, 381, 548, 430, 446

[56] References Cited

U.S. PATENT DOCUMENTS

| | | | |
|---|---|---|---|
| 3,725,067 | 4/1973 | Bailey et al. | 430/476 |
| 4,562,146 | 12/1985 | Masuda et al. | 430/558 |
| 4,585,732 | 4/1986 | Kawagishi et al. | 430/558 |
| 4,588,679 | 5/1986 | Furutachi | 430/558 X |
| 4,594,313 | 6/1986 | Furutachi et al. | 430/558 X |
| 4,600,688 | 7/1986 | Kawakastu et al. | 430/558 |
| 4,621,046 | 11/1986 | Sato et al. | 430/381 |
| 4,639,413 | 1/1987 | Kawagishi et al. | 430/558 X |
| 4,675,280 | 6/1987 | Kaneko et al. | 430/558 |

FOREIGN PATENT DOCUMENTS

| | | |
|---|---|---|
| 0073636 | 3/1983 | European Pat. Off. . |
| 0176056 | 4/1986 | European Pat. Off. . |
| 1247493 | 9/1971 | United Kingdom . |

*Primary Examiner*—Mukund J. Shah

*Attorney, Agent, or Firm*—Sughrue, Mion, Zinn, Macpeak, and Seas

[57] ABSTRACT

A method of forming an image comprising, after color developmenmt of an exposed silver halide color photographic material, processing the developed silver halide color photographic material with a bath having a bleaching ability and subsequently with a bath having a bleach-fixing ability, wherein the silver halide color photographic material comprises a support having coated thereon at least one silver halide emulsion layer and at least one pyrazoloazole type magenta coupler represented by the following general formula (A):

(A)

wherein $R_{22}$ represents a hydrogen atom of a substituent; X represents a group capable of being split off upon a coupling reaction with an oxidation product of an aromatic primary amine developing agent; Za, Zb and Zc each represents a methine group, a substituted methine group, =N— or —NH—, one of the Za—Zb bond and the Zb—ZC bond being a double bond and the other being a single bond; when the Zb—Zc bond is a carbon-carbon double bond, the Zb—Zc bond may be a part of a condensed aromatic ring; $R_{22}$ or X may also form a polymer including a dimer or more; and when Za, Zb or Zc is a substituted methine group, the substituted methine group may form a polymer including a dimer or more. In accordance with the method of forming an image, desilveration is completed in a short period of time and color photographic images having excellent color reproducibility and fastness are obtained without the formation of magenta stain.

41 Claims, No Drawings

IMAGE FORMING METHOD UTILIZING ACCELERATED DESILVERIZATION OF COLOR PHOTOGRAPHIC MATERIAL CONTAINING MAGNETA COUPLER

FIELD OF THE INVENTION

The present invention relates to a method of forming a color photographic image, and more particularly, to an improved method of forming a color image, upon which desilveration is sufficiently conducted in a short period of time and which provides a color image excellent in color reproducibility and fastness.

BACKGROUND OF THE INVENTION

The fundamental steps of processing color photographic light-sensitive materials generally include a color development step and a desilvering step. In the color development step, exposed silver halide is reduced with a color development agent to form silver and the oxidized color developing agent reacts with a color former (coupler) to yield a dye image. In the subsequent desilvering step, the silver thus formed is oxidized in a bleaching bath, further changed into a soluble silver complex by the function of a fixing agent and then dissolved away.

In addition to these fundamental steps of color development processing described above, actual development processing involves various auxiliary steps for maintaining the photographic and physical quality of the resulting image or for improving the preservability of the image. For example, there are illustrated a hardening bath, a stopping bath, an image stabilizing bath and a water washing bath, etc.

In recent years, it has been strongly desired to accelerate the processing, that is, to shorten the processing time. In the above-described color development processing, there is a strong need to shorten the time for the desilvering step which occupies nearly one half of the total processing time.

In response to such a need to shorten the time for the desilvering step, there has been known a bleach-fixing solution, which contains an aminopolycarboxylic acid ferric ion complex salt and a thiosulfate in a single solution, as described in German Pat. No. 866,605. However, the bleaching power of the solution is very weak since an aminopolycarboxylic acid ferric ion complex salt which per se is weak in oxidizing power (bleaching power) and a thiosulfate which has a reducing power coexist in a single solution. Therefore, it is very difficult for the bleach-fixing solution to sufficiently achieve desilveration of color photographic materials for photographing of high sensitivity and high silver content and consequently it can not be employed for practical use.

On the other hand, for the purpose of increasing the bleaching power, there has been proposed a method wherein various bleach accelerators such as mercapto compounds, for example, those described in U.S. Pat. No. 3,893,858 are added to the bleaching bath, the bleach-fixing bath or a prebath thereof. However, the effects of these bleach accelerators are not necessarily sufficient when they are employed in a conventional processing method containing a bleaching bath and a fixing bath.

On the contrary, some of the inventors have previously found that acceleration of desilveration can be achieved and thus significant shortening of the processing time is possible by a method wherein a color photographic material is processed, after color development, with a bleaching bath and subsequently with a bleach-fixing bath, as described in Japanese Patent Application (OPI) Nos. 75352/86 and 75353/86 (the term "OPI" as used herein refers to a "published unexamined Japanese patent application").

However, it has been found that another problem occurs, that is, magenta stain increases, although the time for desilvering is greatly reduced when the desilvering step is carried out using a bleaching bath and a subsequent bleach-fixing bath according to the above-described method.

SUMMARY OF THE INVENTION

Therefore, an object of the present invention is to provide a method of forming an image which can accelerate desilveration of a color photographic light-sensitive material and which is capable of providing an excellent color image having less magenta stain even when a rapid processing is adopted.

Other objects of the present invention will become apparent from the following description and examples.

These objects of the present invention are accomplished by providing a method of forming an image comprising, after color development of an exposed silver halide color photographic material, processing the developed silver halide color photographic material with a bath having a bleaching ability and subsequently with a bath having a bleach-fixing ability, wherein the silver halide color photographic material comprises a support having coated thereon at least one silver halide emulsion layer and at least one pyrazoloazole type magenta coupler represented by the following general formula (A):

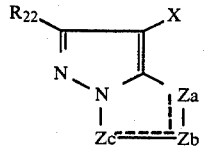

(A)

wherein $R_{22}$ represents a hydrogen atom or a substituent; X represents a group capable of being split off upon a coupling reaction with an oxidation product of an aromatic primary amine developing agent; Za, Zb and Zc each represents a methine group, a substituted methine group, =N— or —NH—, one of the Za—Zb bond and the Zb—Zc bond being a double bond and the other being a single bond; when the Zb—Zc bond is a carbon-carbon double bond, the Zb—Zc bond may be a part of a condensed aromatic ring; $R_{22}$ or X may also form a polymer including a dimer or more; and when Za, Zb or Zc is a substituted methine group, the substituted methine group may form a polymer including a dimer or more.

DETAILED DESCRIPTION OF THE INVENTION

The pyrazoloazole type magenta coupler represented by the general formula (A) above which can be employed in the present invention is described in detail in the following.

The term "polymer" as used in the definition for the general formula (A) means a compound containing at least two groups represented by the general formula (A) in its molecule, and includes a bis coupler, an oligomer coupler (those having a polymerization degree of from 3 to 99) and a polymer coupler (those having a polymerization degree of 100 or more). The term "polymer coupler" as herein used includes a homopolymer composed of only a monomer having a moiety represented by the general formula (A), and preferably having a vinyl group (the monomer having a vinyl group will hereinafter be referred to as a vinyl monomer), or a copolymer composed of a vinyl monomer described above and a noncolor forming ethylenic monomer which does not undergo coupling with the oxidation product of an aromatic primary amine developing agent.

The compounds represented by the general formula (A) are nitrogen containing heterocyclic 5-membered ring-condensed-5-membered ring type couplers. Their color forming nuclei show aromaticity isoelectronic to naphthalene. The preferred compounds among the couplers represented by the general formula (A) are 1H-imidazo[1,2-b]pyrazoles, 1H-pyrazolo[1,5-b]pyrazoles, 1H-pyrazolo[1,5-b][1,2,4]triazoles, 1H-pyrazolo[1,5-d]tetrazoles and 1H-pyrazolo[1,5-a]benzimidazoles represented by the general formulae (A)-2, (A)-3, (A)-4, (A)-5, (A)-6 and (A)-7, respectively. Of them, the compounds represented by the general formulae (A)-2, (A)-4 and (A)-7 are more preferred and those represented by the general formula (A)-4 are particularly preferred.

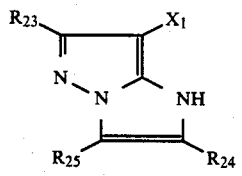
(A)-2

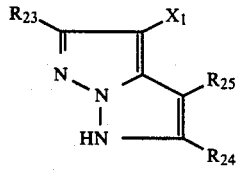
(A-3)

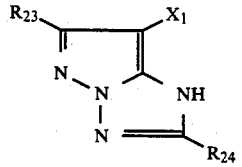
(A)-4

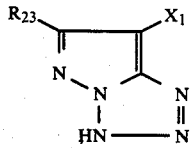
(A)-5

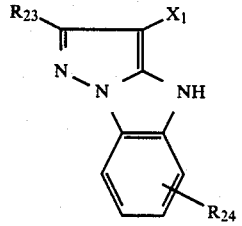
(A)-6

-continued

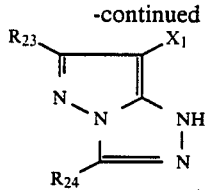
(A)-7

In the general formulae (A)-2, (A)-3, (A)-4, (A)-5, (A)-6 or (A)-7, $R_{23}$, $R_{24}$ and $R_{25}$, which may be the same or different, each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; and $X_1$ represents a halogen atom, a carboxyl group or a group capable of being split off upon coupling which is bonded to the carbon atom at the coupling position through an oxygen atom, a nitrogen atom or a sulfur atom. Also, $R_{23}$, $R_{24}$, $R_{25}$ or $X_1$ may be a divalent group to form a bis coupler. Further, the coupler represented by the general formulae (A)-2, (A)-3, (A)-4, (A)-5, (A)-6 or (A)-7 may be in the form of a polymer coupler in which the general formula constitutes a partial structure of a vinyl monomer and $R_{23}$, $R_{24}$ or $R_{25}$ represents a chemical bond or a linking group, through which the partial structure of the formulae (A)-2, (A)-3, (A)-4, (A)-5, (A)-6 or (A)-7 and the vinyl group are connected together.

In more detail, $R_{23}$, $R_{24}$ and $R_{25}$ each represents a hydrogen atom, a halogen atom (e.g., a chlorine atom, a bromine atom, etc.), an alkyl group (e.g., a methyl group, a propyl group, a tert-butyl group, a trifluoromethyl group, a tridecyl group, a 3-(2,4-di-tert-amylphenoxy)propyl group, a 2-dodecyloxyethyl group, a 3-phenoxypropyl group, a 2-hexylsulfonylethyl group, a cyclopentyl group, a benzyl group, etc.), an aryl group (e.g., a phenyl group, a 4-tert-butylphenyl group, a 2,4-di-tert-amylphenyl group, a 4-tetradecanamidophenyl group, etc.), a heterocyclic group (e.g., a 2-furyl group, a 2-thienyl group, a 2-pyrimidinyl group, a 2-benzothiazolyl group, etc.), a cyano group, an alkoxy group (e.g., a methoxy group, an ethoxy group, a 2-methoxyethoxy group, a 2-dodecyloxyethoxy group, a 2-methanesulfonylethoxy group, etc.), an aryloxy group (e.g., a phenoxy group, a 2-methylphenoxy group, a 4-tert-butylphenoxy group, etc.), a heterocyclic oxy group (e.g., a 2-benzimidazolyloxy group, etc.), an acyloxy group (e.g., an acetoxy group, a hexadecanoyloxy group, etc.), a carbamoyloxy group (e.g., an N-phenylcarbamoyloxy group, an N-ethylcarbamoyloxy group, etc.), a silyloxy group (e.g., a trimethylsilyloxy group, etc.), a sulfonyloxy group (e.g., a dodecylsulfonyloxy group, etc.), an acylamino group (e.g., an acetamido group, a benzamido group, a tetradecanamido group, an α-(2,4-di-tert-amylphenoxy)butylamido group, a γ-(3-tert-butyl-4-hydroxyphenoxy)butylamido group, an α-[4-(4-hydroxyphenylsulfonyl)phenoxy]decanamido group, etc.), an anilino group (e.g., a phenylamino group, a 2-chloroanilino group, a 2-chloro-5-tetradecanamidoanilino group, a 2-chloro-5-dodecyloxycarbonylanilino group, an N-acetylanilino group, a 2-chloro-5-[α-(3-tert-butyl-4-hydroxyphenoxy)dodecanamido]anilino group, etc.), a ureido group (e.g., a phenylureido group, a methylureido group, an N,N-dibutylureido group, etc.), an imido group (e.g., an N-succinimido group, a 3-benzylhydantoinyl group, a 4-(2-ethylhexanoylamino)phthalimido group, etc.), a sulfamoylamino group (e.g., an N,N-dipropylsulfamoylamino group, an N-methyl-N-decylsulfamoylamino group, etc.), an alkylthio group (e.g., a methylthio group, an octylthio group, a tetradecylthio group, a 2-phenoxyethylthio group, a 3-phenoxypropylthio group, a 3-(4-tert-butylphenoxy)propylthio group, etc.), an arylthio group (e.g., a phenylthio group, a 2-butoxy-5-tert-octylphenylthio group, a 3-pentadecylphenylthio group, a 2-carboxyphenylthio group, a 4-tetradecanamidophenylthio group, etc.), a heterocyclic thio group (e.g., a 2-benzothiazolylthio group, etc.), an alkoxycarbonylamino group (e.g., a methoxycarbonylamino group, a tetradecyloxycarbonylamino group, etc.), an aryloxycarbonylamino group (e.g., a phenoxycarbonylamino group, a 2,4-di-tert-butylphenoxycarbonylamino group, etc.), a sulfonamido group (e.g., a methanesulfonamido group, a hexadecanesulfonamido group, a benzenesulfonamido group, a p-toluenesulfonamido group, an octadecanesulfonamido group, a 2-methyloxy-5-tert-butylbenzenesulfonamido group, etc.), a carbamoyl group (e.g., an N-ethylcarbamoyl group, an N,N-dibutylcarbamoyl group, an N-(2-dodecyloxyethyl)carbamoyl group, an N-methyl-N-dodecylcarbamoyl group, an N-[3-(2,4-di-tert-amylphenoxy)propyl]carbamoyl group, etc.), an acyl group (e.g., an acetyl group, a (2,4-di-tert-amylphenoxy)acetyl group, a benzoyl group, etc.), a sulfamoyl group (e.g., an N-ethylsulfamoyl group, an N,N-dipropylsulfamoyl group, an N-(2-dodecyloxyethyl)sulfamoyl group, an N-ethyl-N-dodecylsulfamoyl group, an N,N-diethylsulfamoyl group, etc.), a sulfonyl group (e.g., a methanesulfonyl group, an octanesulfonyl group, a benzenesulfonyl group, a toluenesulfonyl group, etc.), a sulfinyl group (e.g., an octanesulfinyl group, a dodecylsulfinyl group, a phenylsulfinyl group, etc.), an alkoxycarbonyl group (e.g., a methoxycarbonyl group, a butyloxycarbonyl group, a dodecyloxycarbonyl group, an octadecyloxycarbonyl group, etc.) or an aryloxycarbonyl group (e.g., a phenyloxycarbonyl group, a 3-pentadecylphenyloxycarbonyl group, etc.); and $X_1$ represents a hydrogen atom, a halogen atom (e.g., a chlorine atom, a bromine atom, an iodine atom, etc.); a carboxyl group; a group bonded to the coupling position through an oxygen atom (e.g., an acetoxy group, a propanoyloxy group, a benzoyloxy group, a 2,4-dichlorobenzoyloxy group, an ethoxyoxaloyloxy group, a pyruvoyloxy group, a cinnamoyloxy group, a phenoxy group, a 4-cyanophenoxy group, a 4-methanesulfonamidophenoxy group, a 4-methanesulfonylphenoxy group, an -naphthoxy group, a 3-pentadecylphenoxy group, a benzyloxycarbonyloxy group, an ethoxy group, a 2-cyanoethoxy group, a benzyloxy group, a 2-phenethyloxy group, a 2-phenoxyethoxy group, a 5-phenyltetrazolyloxy group, a 2-benzothiazolyloxy group, etc.); a group bonded to the coupling position through a nitrogen atom (e.g., a benzenesulfonamido group, an N-ethyltoluenesulfonamido group, a heptafluorobutanamido group, a 2,3,4,5,6-pentafluorobenzamido group, an octanesulfonamido group, a p-cyanophenylureido group, an N,N-diethylsulfamoylamino group, a 1-piperidyl group, a 5,5-dimethyl-2,4-dioxo-3-oxazolidinyl group, a 1-benzyl-5-ethoxy-3-hydantoinyl group, a 2N-1,1-dioxo-3(2H)-oxo-1,2-benzisothiazolyl group, a 2-oxo-1,2-dihydro-1-pyridinyl group, an imidazolyl group, a pyrazolyl group, a 3,5-diethyl-1,2,4-triazole-1-yl group, a 5- or 6-bromobenzotriazole-1-yl group, a 5-methyl-2,3,4-triazole-1-yl group, a benzimidazolyl group, a 3-benzyl-1-hydantoinyl group, a 1-benzyl-5-hexadecyloxy-3-hydantoinyl group, a 5-methyl-1-tetrazolyl group, a 4-methoxyphenylazo group, a 4-pivaloylaminophenylazo group, a 2-hydroxy-4-propanoylphenylazo group, etc.); or a group bonded to the coupling position through a sulfur atom (e.g., a phenylthio group, a 2-carboxyphenylthio group, a 2-methoxy-5-tert-octylphenylthio group, a 4-methanesulfonylphenylthio group, a 4-octanesulfonamidophenylthio group, a 2-butoxyphenylthio group, a 2-(2-hexanesulfonylethyl)-5-tert-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolylthio group, a 2-dodecylthio-5-thiophenylthio group, a 2-phenyl-3-dodecyl-1,2,4-triazolyl-5-thio group, etc.).

When $R_{23}$, $R_{24}$, $R_{25}$ or $X_1$ represents a divalent group to form a bis coupler, such a divalent group includes a substituted or unsubstituted alkylene group (e.g., a methylene group, an ethylene group, a 1,10-decylene group,—$CH_2CH_2$—O—$CH_2CH_2$—, etc.), a substituted or unsubstituted phenylene group (e.g., a 1,4-phenylene group, a 1,3-phenylene group,

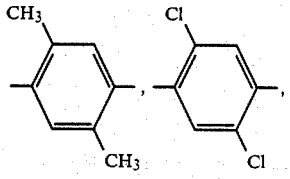

etc.), an —NHCO—$R_{26}$—CONH—group (wherein $R_{26}$ represents a substituted or unsubstituted alkylene or phenylene group).

The linking group represented by $R_{23}$, $R_{24}$, $R_{25}$ or $X_1$ in the cases wherein the coupler moiety represented by the general formulae (A)-2, (A)-3, (A)-4. (A)-5, (A)-6 or (A)-7 is included in a vinyl monomer includes an alkylene group (including a substituted or unsubstituted alkylene group, e.g., a methylene group, an ethylene group, a 1,10-decylene group, —$CH_2CH_2OCH_2CH_2$—, etc.), a phenylene group (including a substituted or unsubstituted phenylene group, e.g., a 1,4-phenylene group, a 1,3-phenylene group,

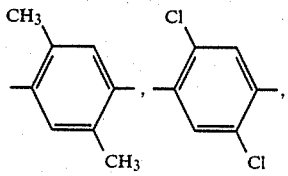

etc.), —NHCO—, —CONH—, —O—, —OCO—, and an aralkylene group

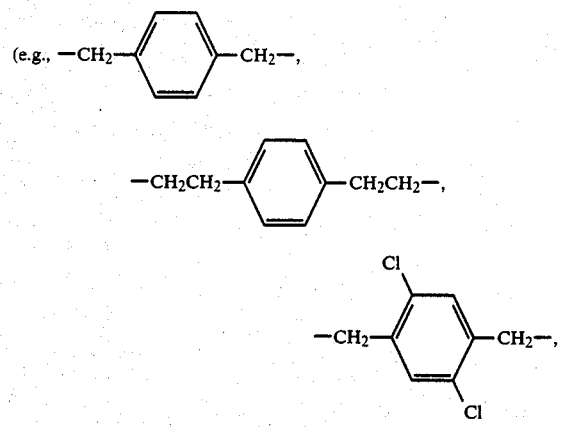

etc.) or a combination thereof.

Further, a vinyl group in the vinyl monomer may further have a substituent in addition to the coupler moiety represented by the general formulae (A)-2, (A)-3, (A)-4, (A)-5, (A)-6 or (A)-7. Preferred examples of the substituents include a chlorine atom or a lower alkyl group having from 1 to 4 carbon atoms.

Examples of non-color forming ethylenic monomers which do not undergo coupling with the oxidation product of an aromatic primary amine developing agent include an acrylic acid (e.g., acrylic acid, α-chloroacrylic acid, α-alkyl substituted acrylic acid (e.g., methacrylic acid, etc.), etc.), an ester or an amide derived from an acrylic acid (e.g., acrylamide, n-butylacrylamide, tert-butylacrylamide, diacetoneacrylamide, methacrylamide, methyl acrylate, ethyl acrylate, n-propyl acrylate, n-butyl acrylate, tert-butyl acrylate, isobutyl acrylate, 2-ethylhexyl acrylate, n-octyl acrylate, lauryl acrylate, methyl methacrylate, ethyl methacrylate, n-butyl methacrylate, β-hydroxyethyl methacrylate, etc.), methylenebisacrylamide, a vinyl ester (e.g., vinyl acetate, vinyl propionate, vinyl laurate, etc.), acrylonitrile, methacrylonitrile, an aromatic vinyl compound (e.g., styrene and a derivative thereof, vinyl toluene, divinylbenzene, vinylacetophenone, sulfostyrene, etc.), itaconic acid, citraconic acid, crotonic acid, vinylidene chloride, a vinylalkyl ether (e.g., vinylethyl ether, etc.), maleic acid, maleic anhydride, a maleic acid ester, N-vinyl-2-pyrrolidone, N-vinylpyridine, 2- or 4-vinylpyridine,etc.

Two or more non-color forming ethylenically unsaturated monomers can be used together.

Specific examples of the pyrazoloazole type magenta couplers represented by the general formulae (A)-2, (A)-3, (A)-4, (A)-5, (A)-6 or (A)-7 which can be used in the present invention and methods for synthesis thereof are described in the following literature.

The compounds of the general formula (A)-2 are described in Japanese Patent Application (OPI) No. 162548/84, etc., the compounds of the general formula (A)-3 are described in Japanese Patent Application (OPI) No. 43659/85, etc., the compounds of the general formula (A)-4 are described in Japanese Patent Application (OPI) Nos. 171956/84 and 172982/85, etc., the compounds of the general formula (A)-5 are described in Japanese Patent Application (OPI) No. 33552/85, etc., the compounds of the general formula (A)-6 are described in U.S. Pat. No. 3,061,432, etc., and the compounds of the general formula (A)-7 are described in Japanese Patent Publication No. 27411/72, etc.

In addition, highly color forming ballast groups as described, for example, in Japanese Patent Application (OPI) Nos. 42045/83, 214854/84, 177553/84, 177554/84 and 177557/84, etc. can be applied to any of the compounds represented by the general formulae (A)-2, (A)-3, (A)-4, (A)-5, (A)-6 or (A)-7 described above.

Specific examples of the pyrazoloazole type magenta couplers which can be employed in the present invention are set forth below, but the present invention should not be construed as being limited thereto.

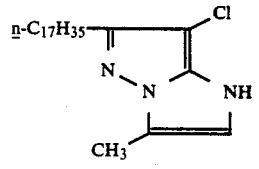

M-1

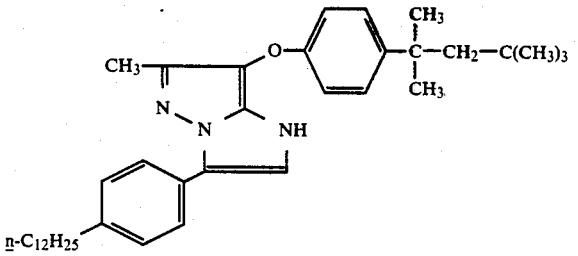

M-2

-continued
M-3
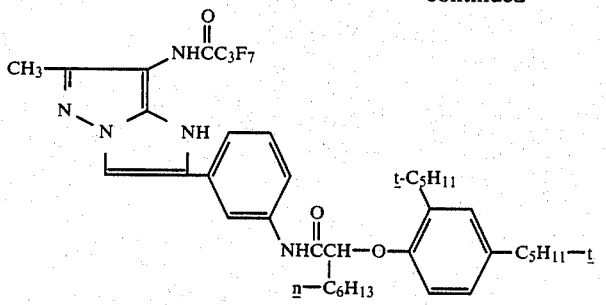
M-4
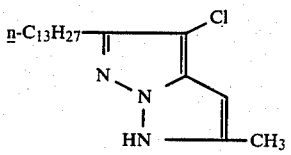
M-5
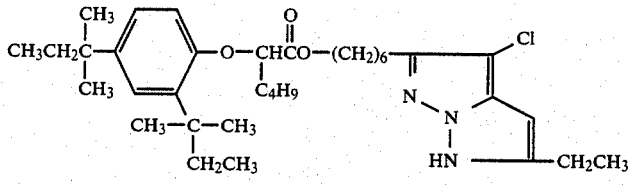
M-6
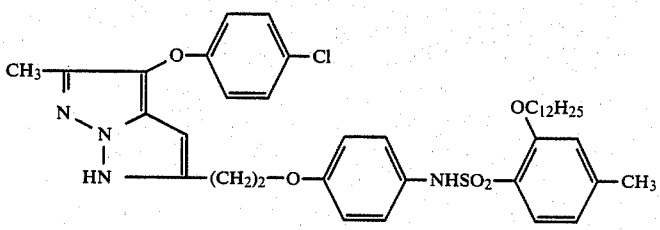
M-7
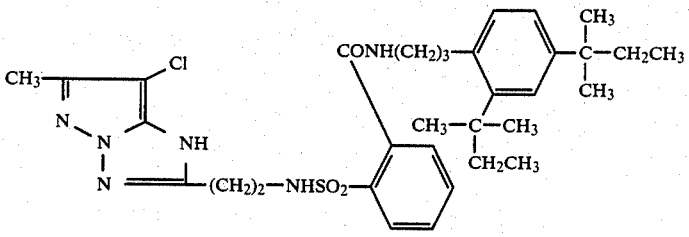
M-8
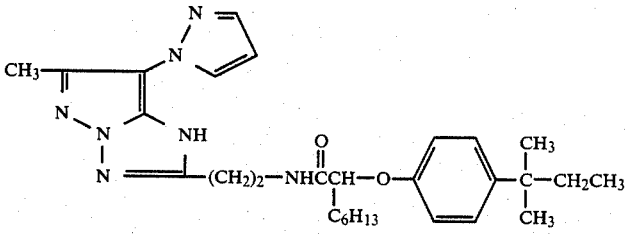
M-9
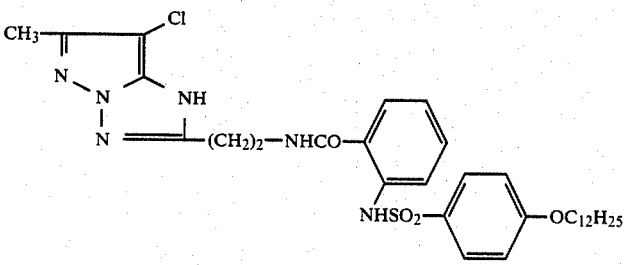

-continued
M-10
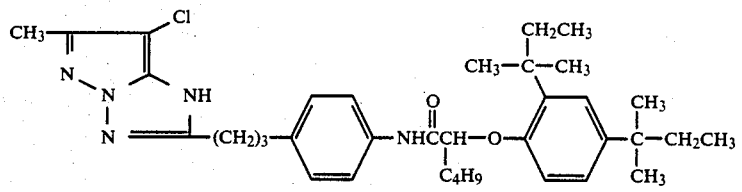
M-11
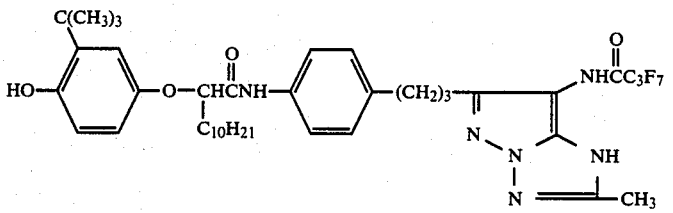
M-12
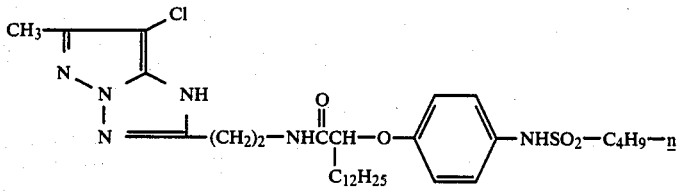
M-13
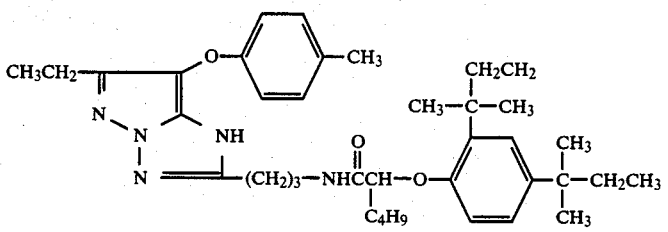
M-14
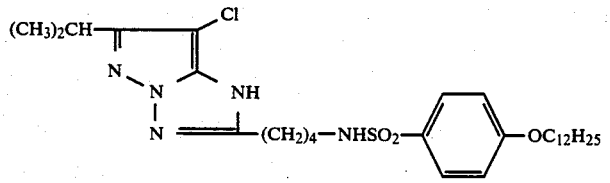
M-15
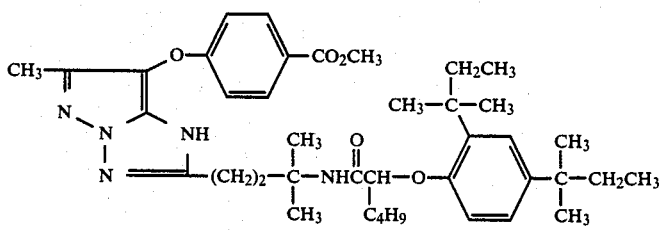
M-16
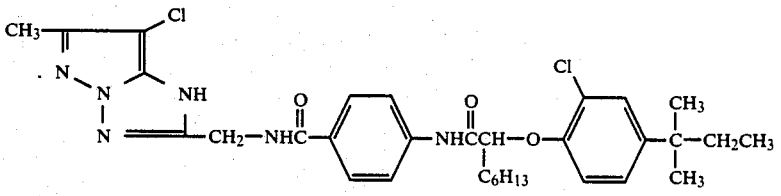

-continued
M-17
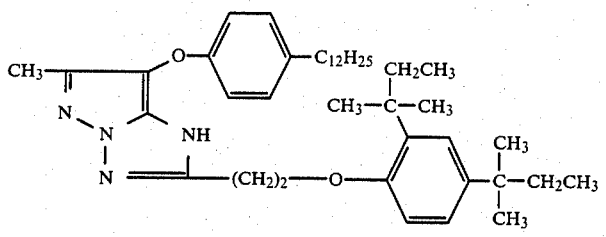
M-18
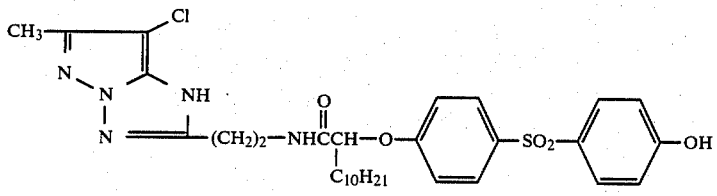
M-19
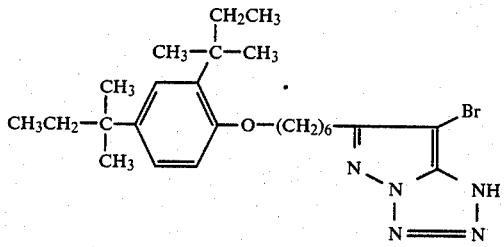
M-20
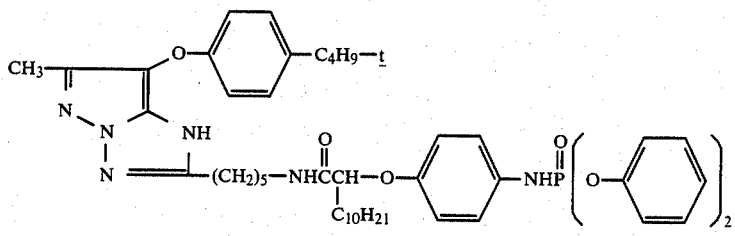
M-21
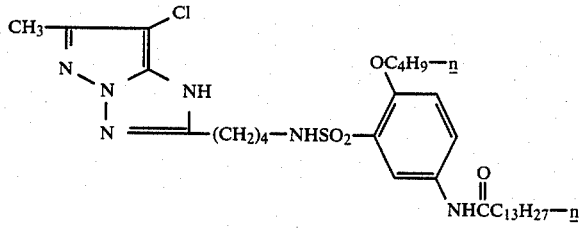
M-22
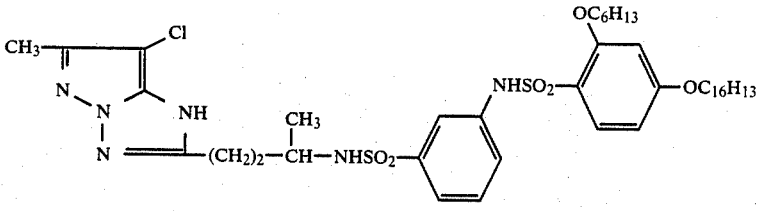
M-23
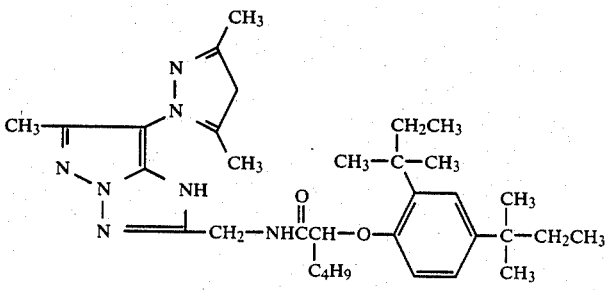

-continued
M-24
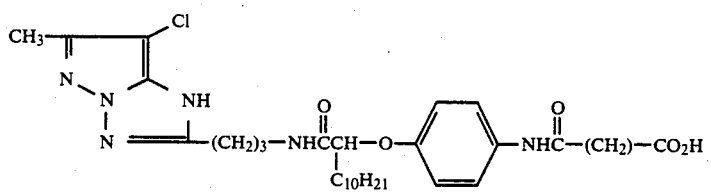
M-25
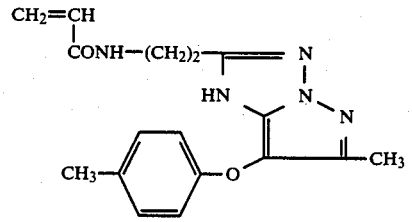
M-26
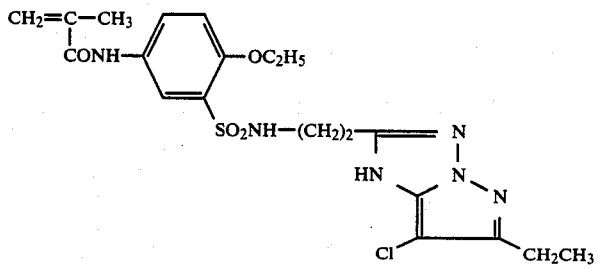
M-27
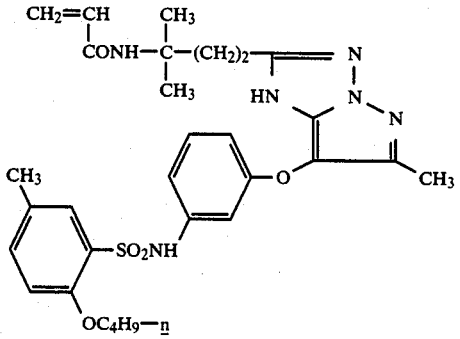
M-28
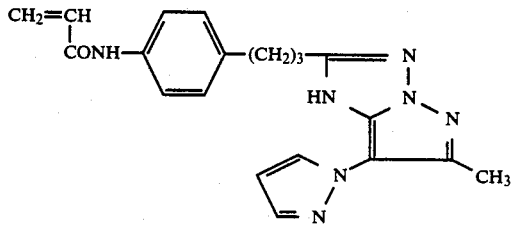
M-29
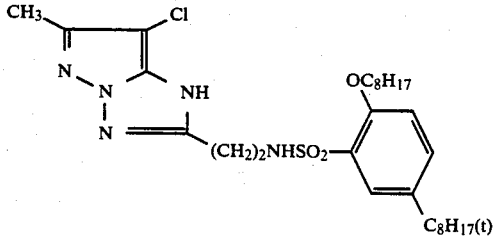

-continued
M-30
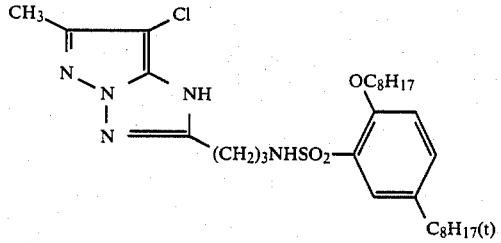
M-31
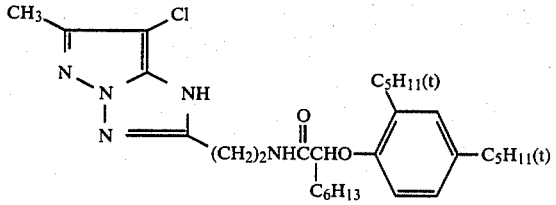
M-32
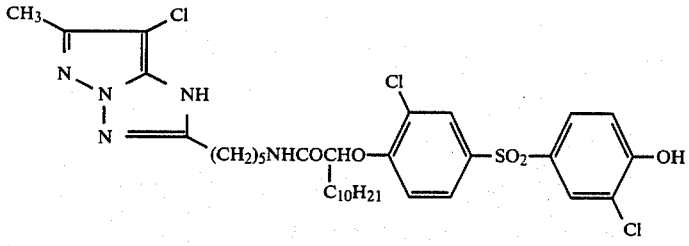
M-33
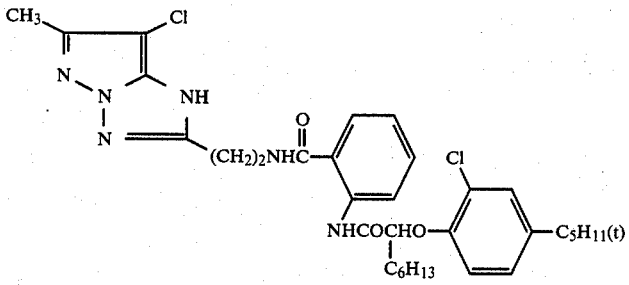
M-34
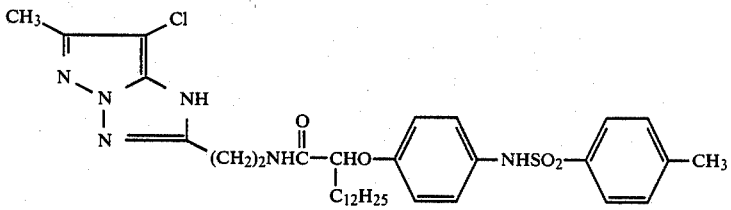
M-35
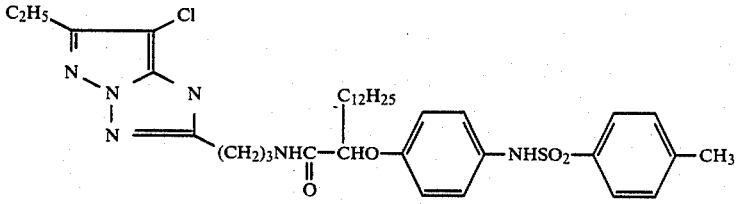
M-36
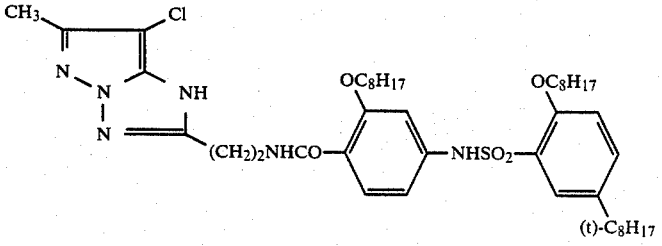

-continued
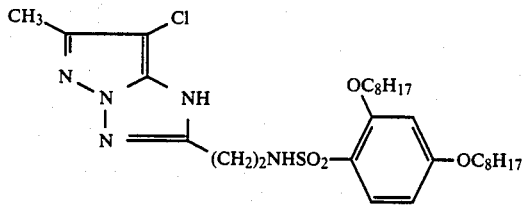
M-37
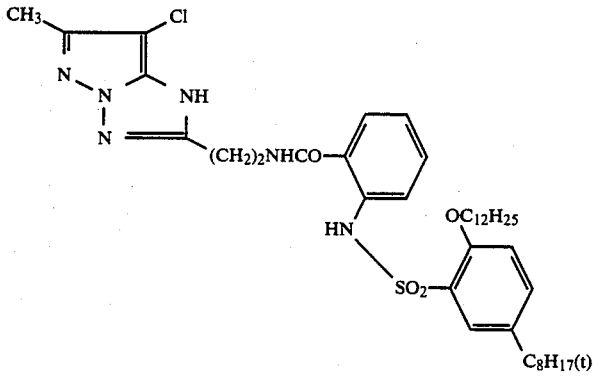
M-38
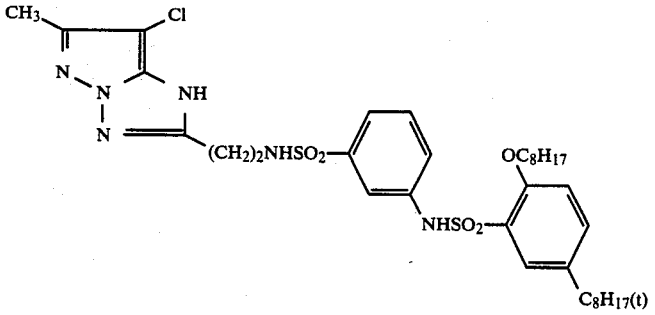
M-39
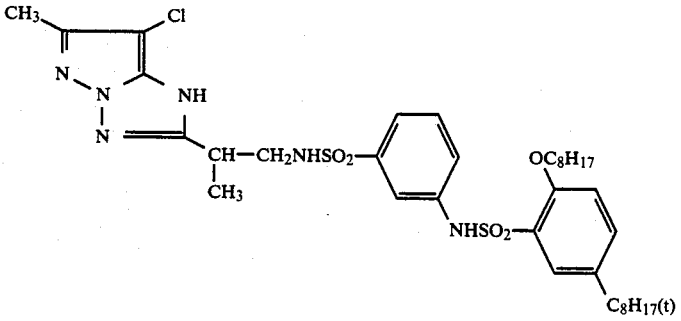
M-40
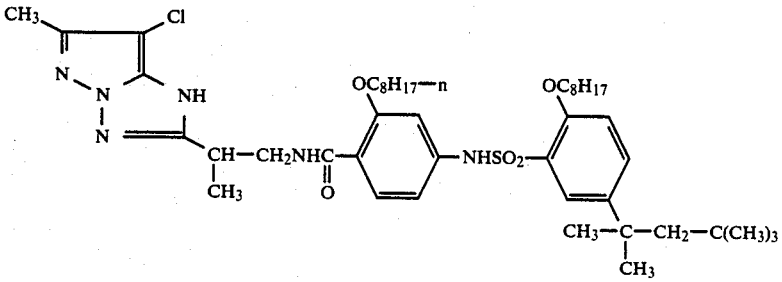
M-41

-continued
M-42
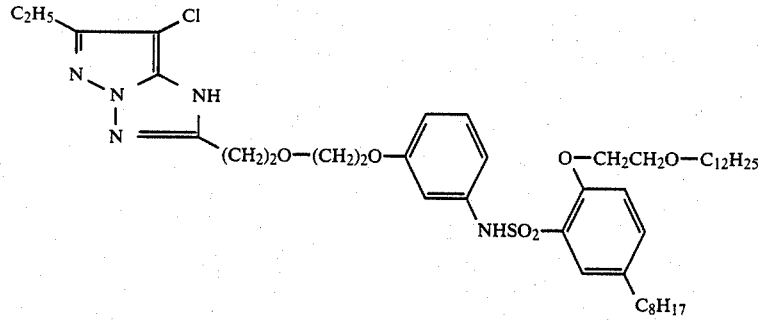
M-43
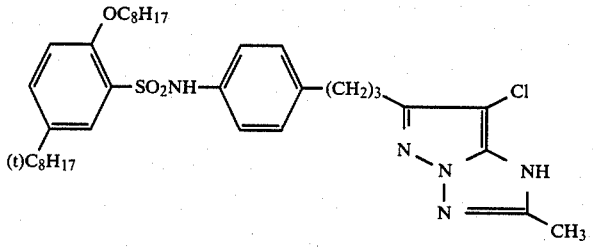
M-44
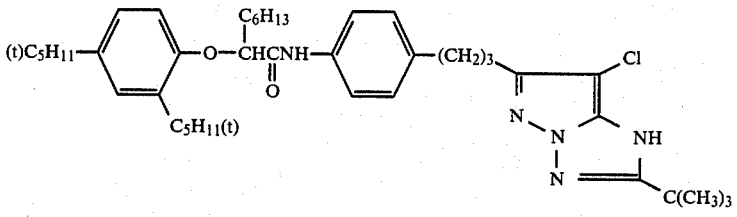
M-45
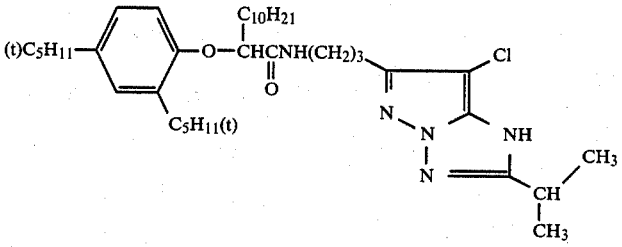
M-46
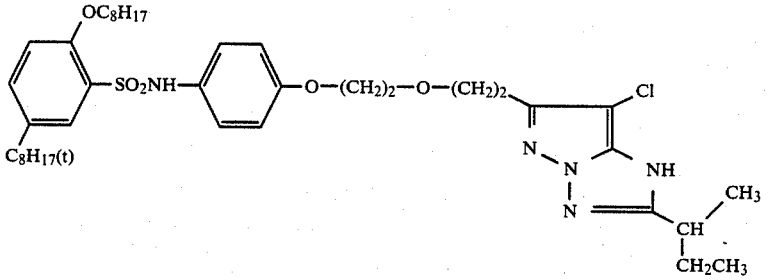
M-47
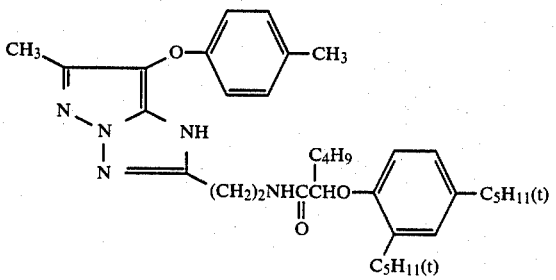

-continued
M-48
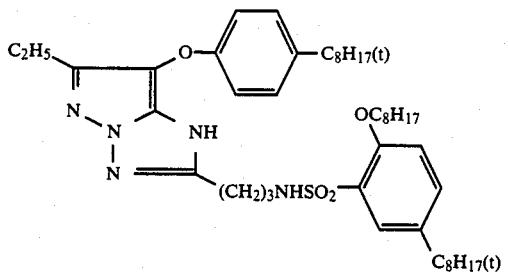
M-49
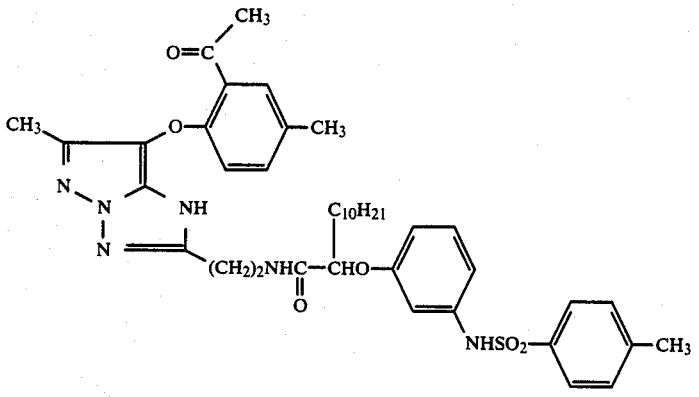
M-50
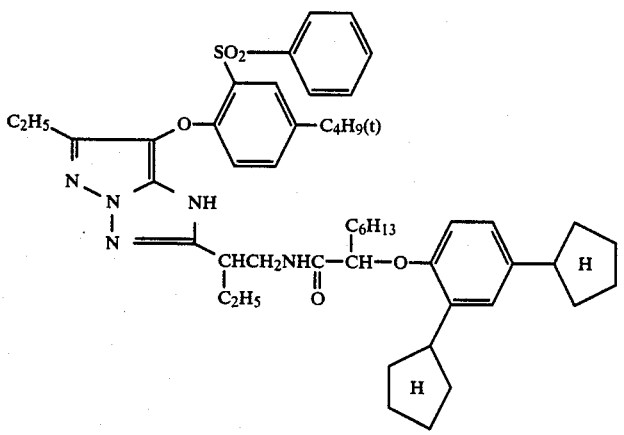
M-51
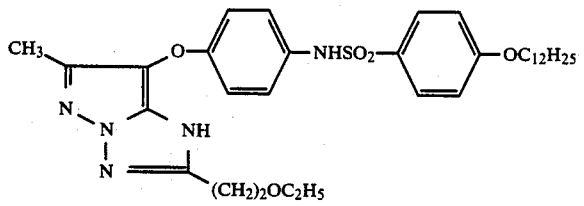
M-52
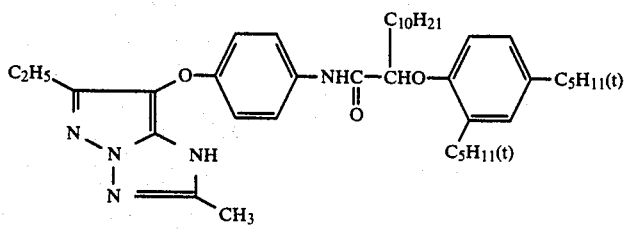

-continued
M-53
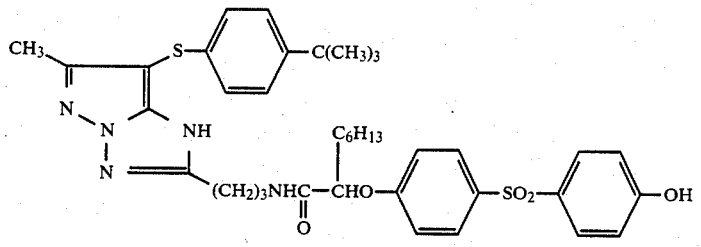
M-54
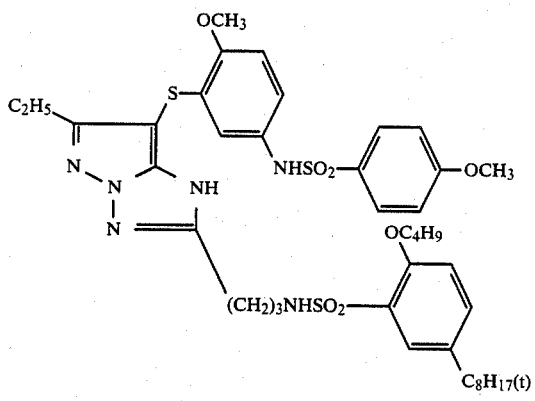
M-55
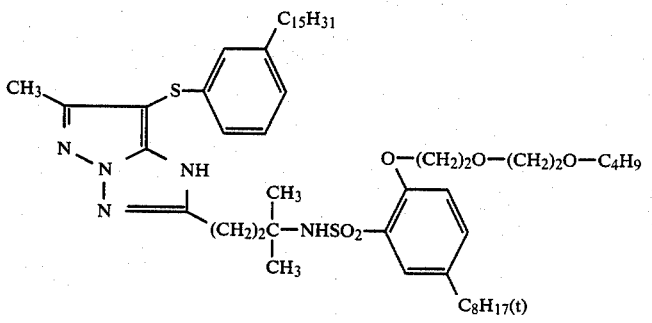
M-56
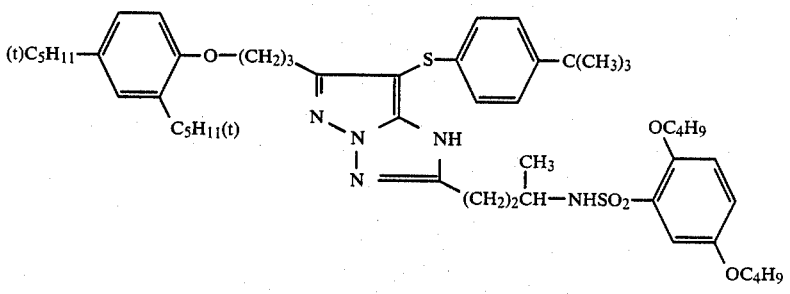
M-57
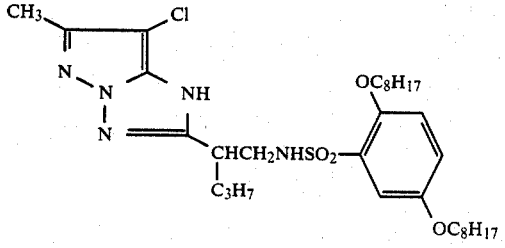

-continued
M-58
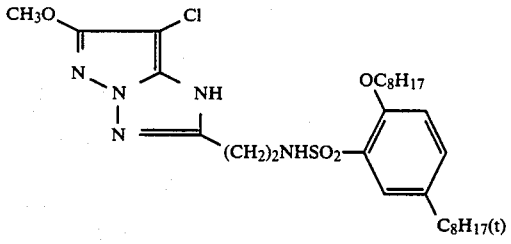
M-59
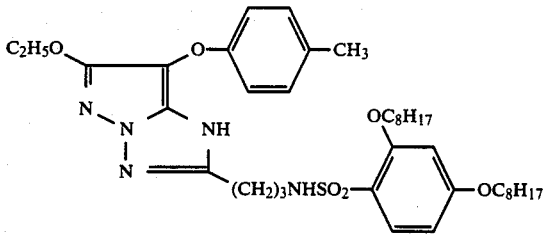
M-60
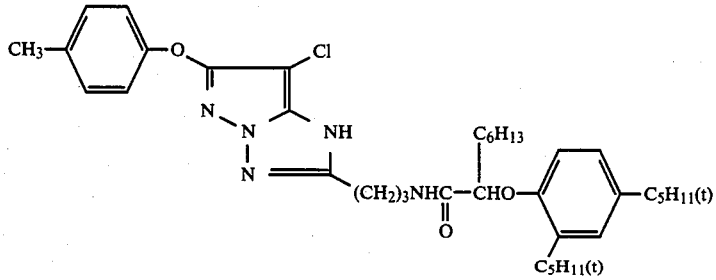
M-61
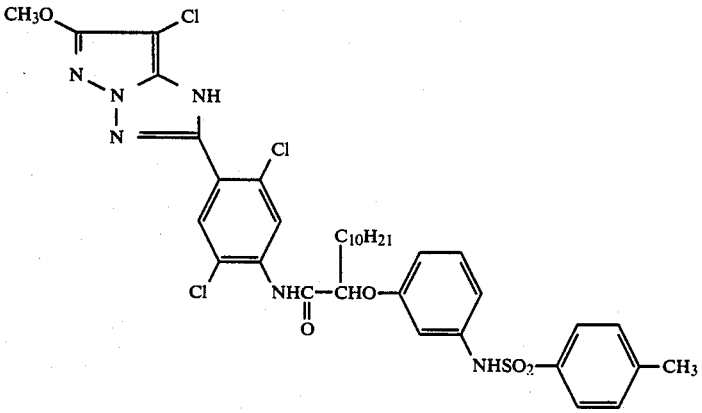
M-62
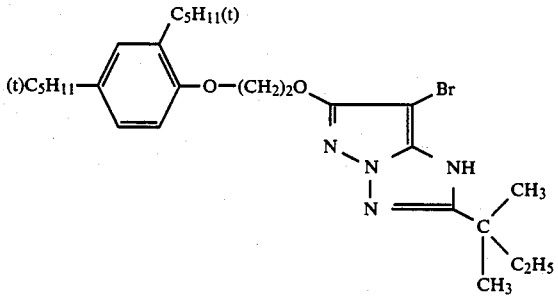

-continued
M-63
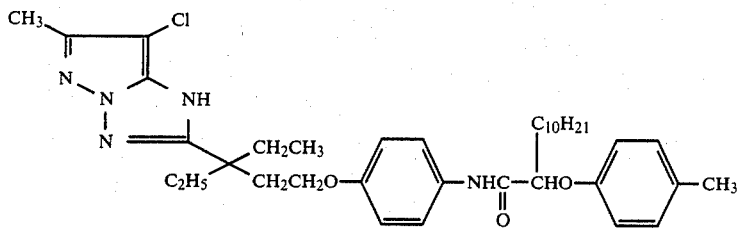
M-64
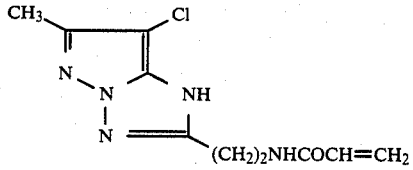
M-65
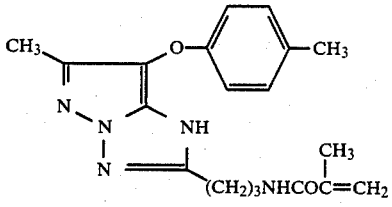
M-66
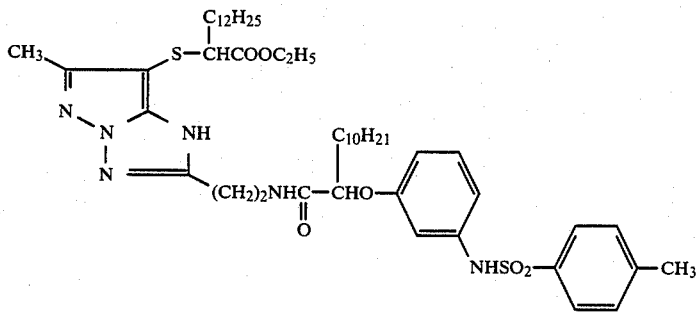
M-67
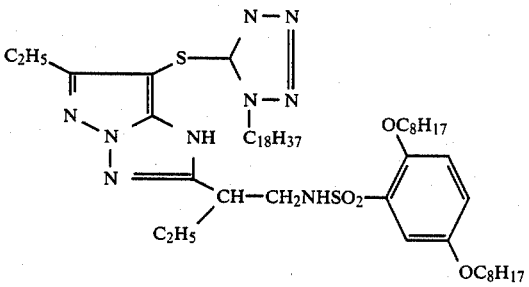
M-68
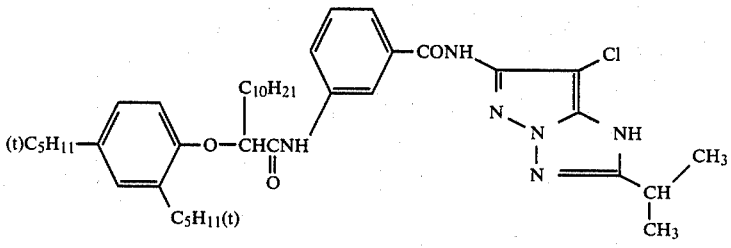

-continued
M-69
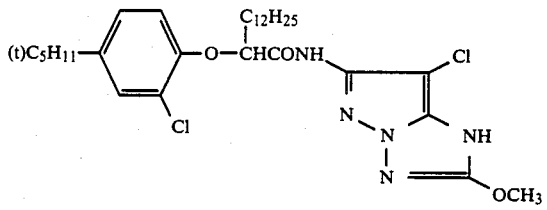
M-70
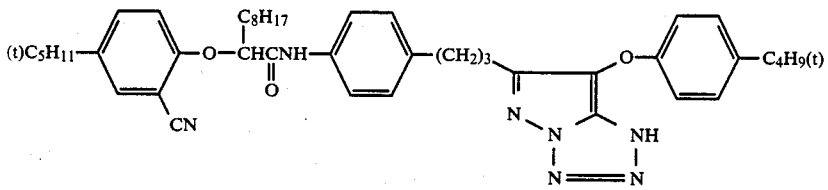
M-71
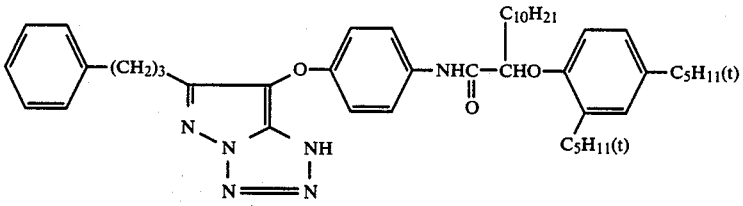
M-72
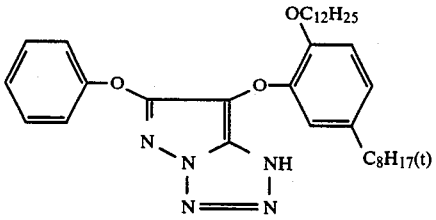
M-73
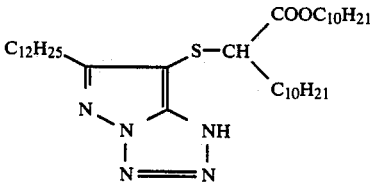
M-74
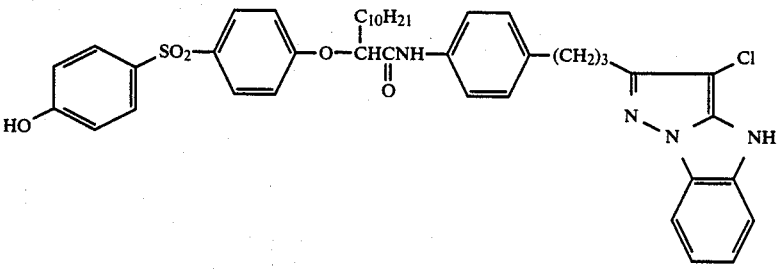
M-75
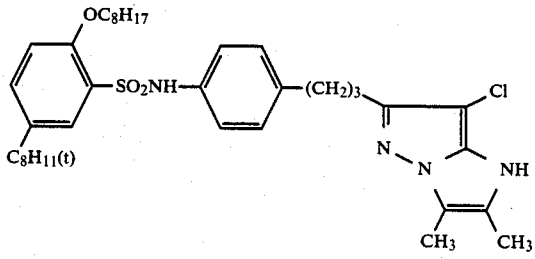

-continued

M-76

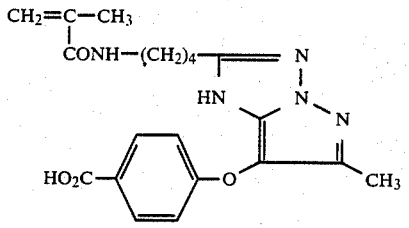

M-77

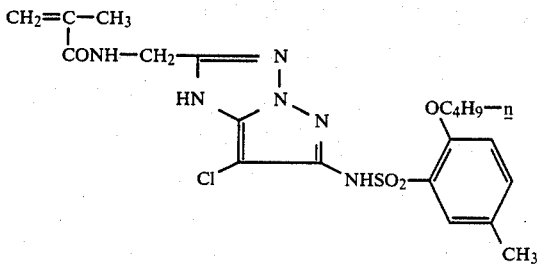

M-78

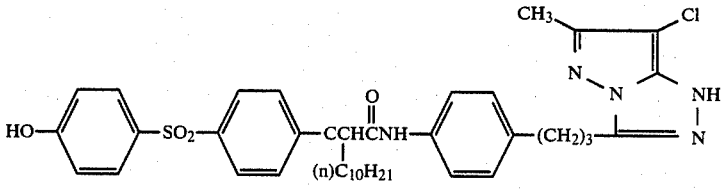

Two or more kinds of the pyrazoloazole type magenta couplers represented by the general formula (A) according to the present invention can be employed in a mixture, and the pyrazoloazole type magenta couplers may be employed together with 5-pyrazolone magenta couplers.

In the present invention, the magenta coupler represented by the general formula (A) can be incorporated into a silver halide emulsion layer or an adjacent layer thereto. An amount of the coupler to be added is from 0.01 g/m$^2$ to 2.0 g/m$^2$, preferably from 0.1 g/m$^2$ to 2.0 g/m$^2$ and more preferably from 0.2 g/m$^2$ to 1.5 g/m$^2$.

A silver halide emulsion layer to which the magenta coupler represented by the general formula (A) is added or to which a layer containing the magenta coupler is adjacent is preferred to be spectrally sensitized. It is particularly preferred that the silver halide emulsion layer is spectrally sensitized to green light.

The silver halide color photographic material containing at least one kind of the pyrazoloazole type magenta couplers represented by the general formula (A) as described in detail hereinabove is subjected, after color development, to development processing with a bath having a bleaching ability and subsequently with a bath having a bleach-fixing ability, whereby excellent color images free from magenta stain can be rapidly obtained.

Now, the bleaching step and fixing step which are conducted after color development according to the present invention are described in detail.

The term "bath having a bleaching ability" (hereinafter referred simply to as a "bleaching bath") means a bath which contains a bleaching component and has an ability of bleaching developed silver. More specifically, the bleaching bath is a bath capable of bleaching at least more than ½, preferably ⅔ or more, and more preferably 4/5 or more of the maximum amount of developed silver contained in the color photographic light-sensitive material. The bleaching solution is a processing bath which desilvers only less than ½, preferably ⅓ or less, and more preferably 1/5 or less of the total coating amount of silver contained in the color photographic light-sensitive material.

The term "bath having a bleach-fixing ability" (hereinafter referred simply to as a "bleach-fixing bath") means a bath which is capable of bleaching the remaining developed silver which is not bleached in the bleaching bath and desilvering it together with the remaining silver salt which is not desilvered in the bleaching bath and which contains a bleaching agent in an amount of 0.05 mol or more per liter. More specifically, the bleach-fixing bath is a bath which bleaches only less than ½, preferably ⅓ or less, and more preferably 1/5 or less of the maximum amount of developed silver contained in the color photographic light-sensitive material. The bleach-fixing solution is a processing bath capable of desilvering at least more than ½, preferably ⅔ or more, and more preferably 4/5 or more of the total coating amount of silver contained in the color photographic light-sensitive material.

The above-described bleaching solution and bleach-fixing solution each may be composed of two or more baths as far as the total number of the baths is 4 or less. Further, a water washing step (including a water washing bath using a small amount of water for reducing the amount of washing water) may be provided between the bleaching bath and the bleach-fixing bath. Moreover, the overflow solution which flows out of the bleaching bath when the bleaching replenisher is added thereto may be introduced directly or indirectly into the subsequent bleach-fixing bath. It is particularly preferred to directly introduce the overflow solution into the bleach-fixing bath. By means of such an introduction, it is possible to cut off wholly or partially an amount of the bleaching agent to be replenished to the bleach-fixing bath.

According to the present invention, any of known bleaching agents, for example, a ferricyanide, a dichromate, a persulfate, an inorganic ferric salt, an organic acid ferric salt, etc. can be employed in the bleaching bath or the bleach-fixing bath. However, an aminopolycarboxylic acid ferric ion complex salt is preferred because of its low water pollution, low metal corrosion and good stability. The aminopolycarboxylic acid ferric ion complex salt is a complex of ferric ion and an aminopolycarboxylic acid or a salt thereof.

Typical examples of the aminopolycarboxylic acids and salts thereof are set forth below, but the present invention should not be construed as being limited thereto.

A-1 Ethylenediaminetetraacetic acid
A-2 Disodium ethylenediaminetetraacetate
A-3 Diammonium ethylenediaminetetraacetate
A-4 Tetra(trimethylammonium) ethylenediaminetetraacetate
A-5 Tetrapotassium ethylenediaminetetraacetate
A-6 Tetrasodium ethylenediaminetetraacetate
A-7 Trisodium ethylenediaminetetraacetate
A-8 Diethylenetriaminepentaacetic acid
A-9 Pentasodium diethylenetriaminepentaacetate
A-10 Ethylenediamine-N-(β-oxyethyl)-N,N',N'-triacetic acid
A-11 Trisodium ethylenediamine-N-(β-oxyethyl)-N,N',N'-triacetate
A-12 Triammonium ethylenediamine-N-(β-oxyethyl)-N,N',N'-triacetate
A-13 Propylenediaminetetraacetic acid
A-14 Disodium propylenediaminetetraacetate
A-15 Nitrilotriacetic acid
A-16 Trisodium nitrilotriacetate
A-17 Cyclohexanediaminetetraacetic acid
A-18 Disodium cyclohexanediaminetetraacetate
A-19 Iminodiacetic acid
A-20 Dihydroxyethylglycine
A-21 Ethyl ether diaminetetraacetic acid
A-22 Glycol ether diaminetetraacetic acid
A-23 Ethylenediaminetetrapropionic acid Among these compounds, A-1, A-2, A-3, A-8 and A-17 are particularly preferred.

The aminopolycarboxylic acid ferric ion complex salt may be used in the form of a complex salt per se or it may be formed in a solution by using a ferric salt such as ferric sulfate, ferric chloride, ferric nitrate, ferric ammonium sulfate, ferric phosphate, etc. with the aminopolycarboxylic acid. The complex salt may be used alone or as a combination of two or more thereof when using it in the form of a complex salt. On the other hand, when a complex salt is formed in a solution using a ferric salt and an aminopolycarboxylic acid, one, two or more ferric salts may be used and one, two or more aminopolycarboxylic acids may be used. In any case, an aminopolycarboxylic acid may be employed in an amount in excess of that necessary for forming a ferric ion complex salt.

The bleaching solution or the bleach-fixing solution containing the ferric ion complex salt may contain other metallic ion complex salts than iron, such as cobalt, copper, etc.

The bleaching bath and bleach-fixing bath used in the present invention may contain, in addition to the bleaching agent and the compounds mentioned above, rehalogenating agents such as bromides (in the present invention, it is preferred to use water-soluble bromides described below), for example, potassium bromide, sodium bromide, ammonium bromide, etc., or chlorides, for example, potassium chloride, sodium chloride, ammonium chloride, etc. Furthermore, the bleaching bath and bleach-fixing bath may contain one or more inorganic acids, organic acids and salts thereof having an ability of buffering a pH, for example, nitrates such as sodium nitrate, ammonium nitrate, etc., boric acid, borax, sodium metaborate, acetic acid, sodium acetate, sodium carbonate, potassium carbonate, phosphorous acid, phosphoric acid, sodium phosphate, citric acid, sodium citrate, tartaric acid, or the like, and compounds having a fixing ability, for example, thiosulfates such as sodium thiosulate, ammonium thiosulfate, ammonium sodium thiosulfate, potassium thiosulfate, etc., thiocyanates such as sodium thiocyanate, ammonium thiocyanate, potassium thiocyanate, etc., thiourea, thioethers, or the like.

The water-soluble bromides which can be preferably used in the present invention are compounds which are dissolved in the bleaching bath and the bleach-fixing bath and release bromine ions. Specific examples thereof include alkali metal bromides such as potassium bromide, sodium bromide, lithium bromide, etc., ammonium bromide, hydrobromic acid, alkaline earth metal bromides such as magnesium bromide, calcium bromide, strontium bromide, etc. Of them, ammonium bromide is particularly preferred.

The water-soluble bromide is used in the bleaching bath in a concentration of from 0.5 to 1.3 mols per liter, preferably from 0.7 to 1.3 mols per liter, and in the bleach-fixing bath in a concentration of from 0.1 to 0.5 mol per liter, preferably from 0.2 to 0.5 mol per liter.

Moreover, various additives may be added to the bleaching bath and the bleach-fixing bath according to the present invention, if desired. For example, sulfites such as sodium sulfite, ammonium sulfite, etc., various defoaming agents, surface active agents, iodides such as potassium iodide, sodium iodide, ammonium iodide, etc., hydroxylamine, hydrazine, and addition products of aldehydes with bisulfite may be added.

The concentration of the bleaching agent used in the bleaching bath used in the present invention is from 0.1 to 1 mol per liter, preferably from 0.2 to 0.5 mol per liter. The pH of the bleaching bath is preferably from 4.0 to 8.0, when used.

In the bleach-fixing bath used in the present invention, the concentration of the bleaching agent is from 0.05 to 0.5 mol per liter, preferably 0.1 to 0.3 mol per liter, and the concentration of the fixing agent is from 0.3 to 3 mols per liter, preferably from 0.5 to 2.5 mols per liter. The pH of the bleach-fixing solution is from 5 to 8, preferably from 6 to 7.5.

To either one or both of the bleaching bath and the bleach-fixing bath used in the present invention, a bleach accelerator may be added. In particular, the bleach acclerators represented by the general formulae (I), (II), (III), (IV), (V), (VI), (VII), (VIII) or (IX) described below are preferably used in the present invention.

It is particularly preferred that such bleach accelerators are included in the bleaching bath.

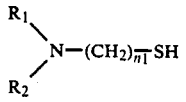

(I)

wherein $R_1$ and $R_2$, which may be the same or different, each represents a hydrogen atom, a substituted or unsubstituted lower alkyl group (preferably having 1 to 5 carbon atoms, particularly, a methyl group, an ethyl group or a propyl group) or an acyl group (preferably having 1 to 3 carbon atoms such as an acetyl group, a propionyl group, etc.), or $R_1$ and $R_2$ may be bonded to each other to form a ring (such as a morpholino ring, a piperidino ring, etc.), but it is preferred that $R_1$ and $R_2$ do not form a ring; and $n_1$ represents an integer from 1 to 3.

The substituted or unsubstituted lower alkyl group is particularly preferred for $R_1$ and $R_2$. Examples of substituents for the substituted group represented by $R_1$ or $R_2$ include a hydroxyl group, a carboxyl group, a sulfo group, an amino group, etc.

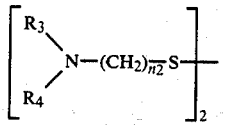

(II)

wherein $R_3$ and $R_4$ each has the same meaning as defined for $R_1$ and $R_2$ in the general formula (I) or may be bonded to each other to form a ring (such as a morpholino ring, a piperidino ring, etc.), but it is preferred that $R_3$ and $R_4$ do not form a ring; and $n_2$ represents an integer from 1 to 3.

The substituted or unsubstituted lower alkyl group is particularly preferred for $R_3$ and $R_4$. Examples of substituents for the substituted group represented by $R_3$ or $R_4$ include a hydroxyl group, a carboxyl group, a sulfo group, an amino group, etc.

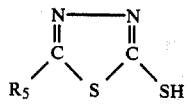

(III)

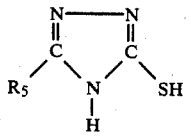

(IV)

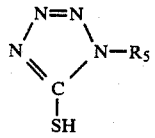

(V)

wherein $R_5$ represents a hydrogen atom, a halogen atom (for example, a chlorine atom, a bromine atom, etc.), an amino group, a substituted or unsubstituted lower alkyl group (preferably having 1 to 5 carbon atoms, particularly, a methyl group, an ethyl group or a propyl group) or an amino group substituted with an alkyl group (for example, a methylamino group, an ethylamino group, a dimethylamino group, a diethylamino group, etc.).

Examples of substituents for the substituted group represented by $R_5$ include a hydroxyl group, a carboxyl group, a sulfo group, an amino group, etc.

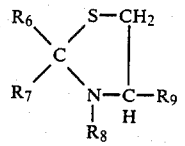

(VI)

wherein $R_6$ and $R_7$, which may be the same or different, each represents a hydrogen atom, a substituted or unsubstituted alkyl group (preferably a lower alkyl group, for example, a methyl group, an ethyl group or a propyl group, etc.), a substituted or unsubstituted phenyl group or a substituted or unsubstituted heterocyclic group (more specifically, a heterocyclic group having one or more hetero atoms such as a nitrogen atom, an oxygen atom or a sulfur atom, etc., for example, a pyridine ring, a thiophene ring, a thiazolidine ring, a benzoxazole ring, a benzotriazole ring, a thiazole ring, an imidazole ring, etc.); $R_8$ represents a hydrogen atom or a substituted or unsubstituted lower alkyl group (preferably having from 1 to 3 carbon atoms, for example, a methyl group or an ethyl group, etc.); and $R_9$ represents a hydrogen atom or a carboxyl group.

Examples of substituents for the substituted group represented by $R_6$, $R_7$ or $R_8$ include a hydroxyl group, a carboxyl group, a sulfo group, an amino group or a lower alkyl group, etc.

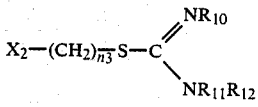

(VII)

wherein $R_{10}$, $R_{11}$ and $R_{12}$, which may be the same or different, each represents a hydrogen atom or a lower alkyl group (preferably having from 1 to 3 carbon atoms, for example, a methyl group or an ethyl group, etc.), or $R_{10}$ and $R_{11}$ or $R_{12}$ may be bonded to each other to form a ring (such as a nitrogen-containing 5- to 7-membered ring); $X_2$ represents a substituted or unsubstituted amino group (examples of substituents including a lower alkyl group such as a methyl group, etc., and an alkoxyalkyl group such as an acetoxymethyl group, etc.), a sulfo group or a carboxyl group; and $n_3$ represents an integer of from 1 to 4.

A hydrogen atom, a methyl group or an ethyl group is particularly preferred for $R_{10}$, $R_{11}$ or $R_{12}$, and an amino group or a dialkylamino group is preferred for X.

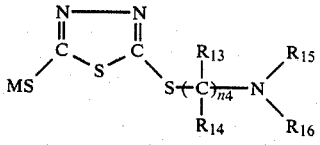

(VIII)

wherein $R_{13}$ and $R_{14}$, which may be the same or different, each represents a hydrogen atom, a hydroxyl group, an amino group which may be substituted by a lower alkyl group that may be substituted by a hydroxyl group or a halogen atom, a carboxyl group, a sulfo group or an alkyl group which may be substituted by a hydroxyl group, a halogen atom, an amino group, or a dialkylamino group; $R_{15}$ and $R_{16}$, which may be the same or different, each represents a hydrogen atom, an alkyl group which may be substituted by a hydroxyl group, a halogen atom, an amino group, or a dialkylamino group, or an acyl group which may be substituted by a hydroxyl group, a halogen atom, or an amino group, or $R_{15}$ and $R_{16}$ may be bonded to each other to form a ring (such as a morpholino ring, a piperidino ring, etc.); M represents a hydrogen atom, an alkali metal atom or an ammonium group; and $n_4$ represents an integer of from 2 to 5.

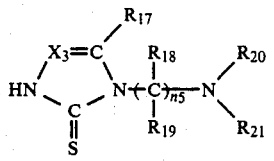

(IX)

wherein $X_3$ represents N or C—R, in which R has the same meanings a s in $R_{17}$, $R_{18}$ and $R_{19}$ as defined below; $R_{17}$, $R_{18}$ and $R_{19}$, which may be the same or different, each represents a hydrogen atom, a halogen atom, an amino group, a hydroxyl group, a carboxyl group, a sulfo group or an alkyl group which may be substituted by a hydroxyl group, a halogen atom, an amino group, or a dialkylamino group; $R_{20}$ and $R_{21}$, which may be the same or different, each represents a hydrogen atom, an alkyl group which may be substituted by a hydroxyl group, a halogen atom, an amino group, or a dialkylamino group or an acyl group which may be substituted by a hydroxyl group, a halogen atom, or an amino group, or $R_{20}$ and $R_{21}$ may be bonded to each other to form a ring (such as a morpholino ring, a piperidino ring, etc.), provided that both $R_{20}$ and $R_{21}$ are not hydrogen atoms at the same time; and $n_5$ represents an integer of from 0 to 5.

In the present invention, the bleaching time is preferably in a range of from 20 to 4 minutes. In case of using the bleach accelerator represented by the general formulae (I), (II), (III), (IV), (V), (VI), (VII), (VIII) or (IX), a bleaching time ranging from 20 seconds to 2 minutes is more preferred. On the other hand, a bleaching time ranging from 1 minute to 4 minutes is more preferred, when such a bleach accelerator is not employed.

The bleach-fixing time is preferably in a range from 1 minute to 5 minutes and more preferably in a range from 1 minute and 30 seconds to 3 minutes and 30 seconds.

The color development processing in the present invention can be conducted in a known manner as roughly described below.

An aromatic primary amine color developing agent to be used in the present invention in a color developing solution includes a wide range of known developing agents for use in various color photographic processes. The color developing agents include aminophenol derivatives and p-phenylenediamine derivatives. These compounds are generally used in the form of salts such as hydrochloride or sulfates rather than in the free form in view of stability advantages. They are generally used in an amount of from about 0.1 g to about 30 g, more preferably from about 1 g to about 15 g, per liter of color developing solution.

The aminophenol type developing agents include, for example, o-aminophenol, p-aminophenol, 5-amino-2-oxytoluene, 2-amino-3-oxytoluene, 2-oxy-3-amino-1,4-dimethylbenzene, etc.

Particularly useful aromatic primary amine type color developing agents are N,N-dialkyl-p-phenylenediamine compounds where the alkyl group and the phenyl group may or may not be substituted. Of these, particularly useful compounds are N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)toluene, N-ethyl-N-β-methanesulfonamidoethyl-3-methyl-4-aminoaniline sulfate, N-ethyl-N-β-hydroxyethylaminoaniline, 4-amino-3-methyl-N,N-diethylaniline, 4-amino-N-(2-methoxyethyl)-N-ethyl-3-methylaniline-p-toluenesulfonate, etc.

The alkaline color developing solution used in the present invention can optionally contain, in addition to the above described aromatic primary amine color developing agent, various ingredients usually added to a color developing solution, such as alkali agents (e.g., sodium hydroxide, sodium carbonate, potassium carbonate, etc.), alkali metal sulfites, alkali metal bisulfites, alkali metal thiocyanates, alkali metal halides, benzyl alcohol, water-softening agents, thickening agents, etc. The pH of the color developing solution is usually 7 or above, most generally from about 9 to about 13.

The method of forming an image according to the present invention is applicable to color reversal processing. In the present invention, as a black-and-white developing solution to be used in such processing, a black-and-white first developing solution used for reversal processing of color photographic light-sensitive materials or a developing solution used for processing black-and-white photographic light-sensitive materials can be used. In addition, various well known additives generally added to a black-and-white developing solution can be incorporated in the solution.

Typical additives include developing agents such as 1-phenyl-3-pyrazolidone, metol, and hydroquinone; preservatives such as sulfites; accelerators comprising alkalis such as sodium hydroxide, sodium carbonate, potassium carbonate, etc.; inorganic or organic inhibitors such as potassium bromide, 2-methylbenzimidazole, methylbenzothiazole, etc.; water-softening agents such as polyphosphoric acid salts; and a slight amount of development inhibitors comprising iodides or mercapto compounds.

In the present invention, a conventional water washing step in which water for washing is supplied in an amount exceeding 50 times the amount of processing solution carried over from the preceding bath per unit area of color photographic material or a water washing step in which water for washing is supplied in an amount not more than 50 times the amount of processing solution carried over from the preceding bath per unit area of color photographic material.

In water for use in the water washing step, various sterilizers or antimolds are included for the purpose of preventing the generation of slime or molds. Further, various chelating agents such as ethylenediaminetetraacetic acid, nitrilotriacetic acid, etc. may be added to the water as water-softening agents.

In the present invention, the water washing step may use only one tank or a countercurrent water washing process using two or more tanks. The latter is more preferred in view of saving water resources.

The amount of the washing water required for the water washing step may be broadly varied depending on the number of tanks for water washing employed and is usually in a range from about 50 ml to about 100 liters per $m^2$ of color photographic light-sensitive material. The optimum amount can be calculated based on the description in S. R. Goldwasser, "Water Flow Rates in Immersion Washing of Motion Picture Film" in *Journal of the Society of Motion Picture and Television Engineers,* Vol. 64, pages 248 to 253 (May, 1955).

The washing water according to the present invention usually has a pH of around 7. However, the pH of the washing water may vary in a range of from 3 to 9 due to the carrying in of the pre-bath. Further, the temperature of the washing water is in a range of from 5° C. to 40° C., and preferably of from 10° C. to 35° C. In a water washing tank, a heater, a temperature controller, a circulation pump, a filter, a floating cover, a squeezer, etc. may be provided, if desired.

In the present invention, the water washing time is usually in a range of from 20 seconds to 5 minutes, preferably in a range of from 30 seconds to 3 minutes, and particularly preferably in a range of from 30 seconds to 2 minutes. While the effect of the present invention can be attained by any water washing time, it is particularly remarkably obtained when the water washing time is shortened.

Application (OPI) Nos. 12360/76, 82408/78, 144319/78, 100717/79 and 155828/79, etc.) may be employed, if desired.

During the step of formation or physical ripening of silver halide grains, cadmium salts, zinc salts, lead salts, thallium salts, iridium salts or complex salts thereof, rhodium salts or complex salts thereof, iron salts or complex salts thereof, etc. may be allowed to coexist.

The photographic emulsions in the present invention are usually conducted with physical ripening, chemical ripening and spectral sensitization. Various kinds of additives which can be employed in these steps are described in *Research Disclosure,* No. 17643 (December, 1978) and *ibid.,* No. 18716 (November, 1979) as mentioned above and concerned items thereof are summarized in the table shown below.

Further, known photographic additives which can be used in the present invention are also described in the above mentioned *Research disclosures,* and concerned items thereof are summarized in the table shown below.

| Kind of Additives | RD17643 | RD18716 |
|---|---|---|
| 1. Chemical Sensitizers | p. 23 | p. 648, right column |
| 2. Sensitivity Increasing Agents | | p. 648, right column |
| 3. Spectral Sensitizers and Supersensitizers | pp. 23–24 | p. 648, right column to p. 649, right column |
| 4. Whitening Agents | p. 24 | |
| 5. Antifoggants and Stabilizers | pp. 24–25 | p. 649, right column |
| 6. Light-Absorbers, Filter Dyes, and Ultraviolet Light Absorbers | pp. 25–26 | p. 649, right column to p. 650, left column |
| 7. Antistaining Agents | p. 25, right column | p. 650, left column to right column |
| 8. Dye Image Stabilizers | p. 25 | |
| 9. Hardeners | p. 26 | p. 651, left column |
| 10. Binders | p. 26 | p. 651, left column |
| 11. Plasticizers and Lubricants | p. 27 | p. 650, right column |
| 12. Coating Aids and Surfactants | pp. 26–27 | p. 650, right column |
| 13. Antistatic Agents | p. 27 | p. 650, right column |

As a stabilizing solution used in a stabilizing step, a processing solution for stabilizing dye images can be employed. For example, a solution having a buffering function to maintain a pH of 3 to 6, a solution containing an aldehyde (for example, formalin, etc.), etc. can be employed. In the stabilizing solution, a fluorescent whitening agent, a chelating agent, a sterilizer, an antimold, a hardening agent, a surface active agent, etc. may be used, if desired.

The silver halide photographic emulsion of the color photographic light-sensitive material used in the present invention can be prepared using appropriately known methods, for example, those as described in *Research Disclosure,* Vol. 176, No. 17643 (December, 1978), pages 22 to 23, "I. Emulsion Preparation and Types" and *ibid.,* Vol. 187, No. 18716 (November, 1979), page 648, etc.

Photographic emulsions useful in the color photographic light-sensitive material as used in the present invention can be prepared in any suitable manner, for example, by the methods as described in P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964).

In the preparation of photographic emulsion, various silver halide solvents (for example, ammonia, potassium thiocyanate, and thioethers and thione compounds as described in U.S. Pat. No. 3,271,157, Japanese Patent Examples of the silver halide which can be used in the present invention include AgBr, AgBI, AgClBrI, etc., with AgBrI having a content of AgI of from 0.5 to 10 mol% being preferred.

The silver halide color photographic material according to the present invention has at least one green-sensitive silver halide emulsion layer, at least one blue-sensitive silver halide emulsion layer, and at least one red-sensitive silver halide emulsion layer. In this case, it is preferred that the pyrazoloazole type magenta coupler represented by the general formula (A) according to the present invention is present in the green-sensitive emulsion layer, a yellow dye forming coupler is present in the blue-sensitive emulsion layer, and a cyan dye forming coupler is present in the red-sensitive emulsion layer.

As typical yellow couplers useful in the color photographic light-sensitive material used in the present invention, hydrophobic acylacetamide type couplers having a ballast group are exemplified. Specific examples thereof are described in U.S. Pat. Nos. 2,407,210, 2,875,057 and 3,265,506, etc.

In the method of the present invention two-equivalent yellow couplers are preferably employed. Typical examples of two-equivalent yellow couples include yellow couplers of an oxygen atom releasing type as described in U.S. Pat. Nos. 3,408,194, 3,447,928, 3,933,501 and 4,022,620, etc. and yellow couplers of a nitrogen atom releasing type as described in Japanese Patent Publication No. 10739/83, U.S. Pat. No. b 4,401,752 and 4,326,024, *Research Disclosure,* No. 18053 (April, 1979), British Pat. No. 1,425,020, West German Patent Application (OLS) Nos. 2,219,917, 2,261,361, 2,329,587 and 2,433,812, etc. α-Pivaloylacetanilide type couplers are characterized by fastness, particularly light fastness, of dyes formed, and α-benzoylacetanilide type couplers are characterized by providing a high color density.

As cyan couplers useful in the color photographic light-sensitive material used in the present invention, hydrophobic and diffusion-resistant naphthol type and phenol type couplers are exemplified. Typical examples thereof include naphthol type couplers as described in U.S. Pat. No. 2,474,293 and preferably oxygen atom releasing type two-equivalent naphthol type couplers as described in U.S. Pat. Nos. 4,052,212, 4,146,396, 4,228,233 and 4,296,200, etc. Specific examples of phenol type couplers are described in U.S. Pat. Nos. 2,369,929, 2,801,171, 2,772,162 and 2,895,826, etc.

Cyan couplers capable of forming cyan dyes fast to humidity and temperature are preferably used in the present invention. Typical examples thereof include phenol type cyan couplers having an alkyl group more than a methyl group at the meta-position of the phenol nucleus as described in U.S. Pat. No. 3,772,002, 2,5-diacylamino-substituted phenol type couplers as described in U.S. Pat. Nos. 2,772,162, 3,758,308, 4,126,396, 4,334,011 and 4,327,173, West German Patent Application (OLS) No. 3,329,729, and European Pat. No. 121,365, etc., phenol type couplers having a phenylureido group at the 2-position thereof and an acylamino group at the 5-position thereof as described in U.S. Pat. Nos. 3,446,622, 4,333,999, 4,451,559 and 4,427,767, etc. Further, cyan couplers of the naphthol type having a sulfonamido group or an amido group, etc. at the 5-position thereof as described in Japanese Patent Application (OPI) Nos. 237448/85, 153640/86 and 145557/86 are also preferably employed in the present invention because of excellent fastness of color images formed therefrom.

Typical examples of cyan couplers which can be employed together with the above-described cyan couplers include naphthol type couplers as described in U.S. Pat. No. 2,474,293 and preferably oxygen atom releasing type two-equivalent naphthol type couplers as described in U.S. Pat. Nos. 4,052,212, 4,146,396, 4,228,233 and 4,296,200, etc.

In the present invention, it is preferred to use colored couplers for masking together in color photographic light-sensitive materials for photographing in order to correct undesirable absorptions of dyes formed. Specific examples of useful colored couplers are described in *Research Disclosure,* No. 17643 (December, 1978), "VII-G" as mentioned above.

Further, couplers capable of forming appropriately diffusible dyes can be used together in order to improve graininess. Specific examples of such types of magenta couplers are described in U.S. Pat. No. 4,366,237 and British Pat. No. 2,125,570, etc. and those of yellow, magenta and cyan couplers are described in European Pat. No. 96,570 and West German Patent Application (OLS) No. 3,234,533, etc.

Dye forming couplers and the above described special couplers may form polymers including dimers or more. Typical examples of polymerized dye forming couplers are described in U.S. Pat. Nos. 3,451,820 and 4,080,211, etc. Specific examples of polymerized magenta couplers are described in British Pat. No. 2,102,173 and U.S. Pat. No. 4,367,282, etc.

Couplers capable of releasing a photographically useful residue during the course of coupling can also be employed preferably in the present invention. Specific examples of useful DIR couplers capable of releasing a development inhibitor are described in the patents cited in *Research Disclosure,* No. 17643 (December, 1978), "VII-F" as mentioned above.

The cyan couplers according to the present invention are employed in an amount of from 0.002 mol to 0.5 mol per mol of light-sensitive silver halide present in a layer into which the couplers are incorporated in order to achieve the objects of the present invention.

The couplers which can be used in the present invention can be incorporated into photographic light-sensitive materials using various known dispersing methods. Typical examples thereof include a solid dispersing method, an alkali dispersing method, preferably a latex dispersing method and more preferably an oil-in-water droplet dispersing method. By means of the oil-in-water droplet dispersing method, couplers are dissolved in either an organic solvent having a high boiling point of 175° C. or more, a so-called auxiliary solvent having a low boiling point, or a mixture thereof and then the solution is finely dispersed in an aqueous medium such as water or an aqueous gelatin solution, etc. in the presence of surface active agents. Specific examples of the organic solvents having a high boiling point are described in U.S. Pat. No. 2,322,027, etc. In order to prepare a dispersion, phase inversion may be accompanied. Further, dispersions are utilized for coating after removing or reducing the auxiliary solvent therein by distillation, noodle washing or ultrafiltration, etc., if desired.

The color photographic light-sensitive material used in the present invention may contain hydroquinone derivatives, aminophenol derivatives, amines, gallic acid derivatives, catechol derivatives, ascorbic acid derivatives, noncolor-forming couplers, sulfonamidophenol derivatives, etc., as color fog preventing agents or color mixing preventing agents.

In the color photographic light-sensitive material used in the present invention, various color fading preventing agents can be employed. Typical examples of organic color fading preventing agents include hindered phenols, for example, hydroquinones, 6-hydroxychromans, 5-hydroxycoumarans, spirochromans, p-alkoxyphenols, bisphenols, etc., gallic acid derivatives, methylendioxybenzenes, aminophenols, hindered phenols, or ether or ester derivatives thereof derived from each of these compounds by silylation or alkylation of the phenolic hydroxyl group thereof. Further, metal complexes represented by (bis-salicylaldoxymate) nickel complexes and (bis-N,N-dialkyldithiocarbamate) nickel complexes may be employed.

For the purpose of simplification and acceleration of processing, a color developing agent or a precursor thereof may be incorporated into the silver halide color photographic material used in the present invention. In order to incorporate the color developing agent, it is preferred to employ various precursors of color developing agents in view of increasing the stability of the color photographic material. Suitable examples of the precursors include indoaniline type compounds as described in U.S. Pat. Nos. 3,342,597, Schiff's base type compounds as described in U.S. Pat. No. 3,342,599 and *Research Disclosure,* No. 14850 (August, 1976) and ibid., No. 15159 (November, 1976), aldol compounds as described in *Research Disclosure, No.* 13924 (November, 1975), metal salt complexes as described in U.S. Pat. No. 3,719,492, urethane type compounds as described in Japanese Patent Application (OPI) No. 135628/78, and various salt type precursors as described in Japanese Patent Application (OPI) Nos. 6235/81, 16133/81, 59232/81, 67842/81, 83734/81, 83735/81, 83736/81, 89735/81, 81837/81, 54430/81, 106241/81, 107236/81, 97531/82 and 83565/82, etc.

Further, the silver halide color photographic material used in the present invention may contain various 1-phenyl-3-pyrazolidones for the purpose of accelerating color development. Typical examples of the compounds are described in Japanese Patent Application (OPI) Nos. 64339/81, 144547/82, 211147/82, 50532/83, 50536/83, 50533/83, 50534/83, 50535/83 and 115438/83, etc.

In accordance with the method of forming an image of the present invention, the occurrence of magenta stain is prevented even when an accelerated process is adopted for color development processing. Therefore, the present invention has great importance in the recent trend to pursue rapid processing.

The present invention is explained in greater detail with reference to the following examples, but the present invention should not be construed as being limited thereto.

Unless otherwise specified, all percents, ratios, etc. are by weight.

EXAMPLE 1

On a cellulose triacetate film support were coated layers having the compositions set forth below to prepare multilayer color photographic light-sensitive materials, which were designated Samples 101 to 111.

First Layer: Antihalation Layer

A gelatin layer containing black colloidal silver.

Second Layer: Interlayer

A gelatin layer

Third Layer: First Red-Sensitive Emulsion Layer

| | |
|---|---|
| A silver iodobromide emulsion (iodide content: 6 mol %, average particle size: 0.6μ), silver coated amount: | 0.023 mol/m$^2$ |
| Sensitizing Dye I | $1.2 \times 10^{-4}$ mol per mol of silver |
| Sensitizing Dye II | $4.0 \times 10^{-5}$ mol per mol of silver |
| Sensitizing Dye III | $5.6 \times 10^{-4}$ mol per mol of silver |
| Sensitizing Dye IV | $4.0 \times 10^{-4}$ mol per mol of silver |
| Coupler 1 | 0.05 mol per mol of silver |
| Coupler 2 | 0.003 mol per mol of silver |
| Coupler 3 | 0.002 mol per mol of silver |
| Di-n-butyl phthalate | 1.0 g per g of Couplers |

Fourth Layer: Second Red-Sensitive Emulsion Layer

| | |
|---|---|
| A silver iodobromide emulsion (iodide content: 8 mol %, average particle size: 1.0μ), silver coated amount: | 0.011 mol/m$^2$ |
| Sensitizing Dye I | $5.0 \times 10^{-5}$ mol per mol of silver |
| Sensitizing Dye II | $1.5 \times 10^{-5}$ mol per mol of silver |
| Sensitizing Dye III | $2.0 \times 10^{-4}$ mol per mol of silver |
| Sensitizing Dye IV | $1.5 \times 10^{-4}$ mol per mol of silver |

-continued

| | |
|---|---|
| Coupler 4 | 0.02 mol per mol of silver |
| Coupler 2 | 0.002 mol per mol of silver |
| Di-n-butyl phthalate | 1.0 g per g of Couplers |

Fifth Layer: Interlayer

A gelatin layer containing $2.2 \times 10^{-4}$ mol/m$^2$ of 2,5-di-tert-octylhydroquinone and 0.1 ml/m$^2$ tricresyl phosphate

Sixth Layer: First Green-Sensitive Emulsion Layer

| | |
|---|---|
| A silver iodobromide emulsion (iodide content: 6 mol %, average particle size: 0.6μ), silver coated amount: | 0.011 mol/m$^2$ |
| Sensitizing Dye V | $4.0 \times 10^{-4}$ mol per mol of silver |
| Sensitizing Dye VI | $3.0 \times 10^{-5}$ mol per mol of silver |
| Sensitizing Dye VII | $1.0 \times 10^{-4}$ mol per mol of silver |
| Coupler 7 (shown in Table 1 below) | 0.10 mol per mol of silver |
| Coupler 5 | 0.03 mol per mol of silver |
| Coupler 6 | 0.01 mol per mol of silver |
| Tricresyl phosphate | 1.5 g per g of Couplers |

Seventh Layer: Second Green-Sensitive Emulsion Layer

| | |
|---|---|
| A silver iodobromide emulsion (iodide content: 8 mol %, average particle size: 1.0μ), silver coated amount: | 0.009 mol/m$^2$ |
| Sensitizing Dye V | $2.7 \times 10^{-4}$ mol per mol of silver |
| Sensitizing Dye VI | $1.8 \times 10^{-5}$ mol per mol of silver |
| Sensitizing Dye VII | $7.5 \times 10^{-5}$ mol per mol of silver |
| Coupler 7 (shown in Table 1 below) | 0.02 mol per mol of silver |
| Coupler 5 | 0.006 mol per mol of silver |
| Tricresyl phosphate | 1.5 g per g of Couplers |

Eighth Layer: Yellow Filter Layer

A gelatin layer containing 0.1 g/m$^2$ of yellow colloidal silver and an emulsified dispersion of 2,5-di-tert-octylhydroquinone (0.05 g/m$^2$) and tricresyl phosphate (0.04 ml/m$^2$)

Ninth Layer: First Blue-Sensitive Emulsion Layer

| | |
|---|---|
| A silver iodobromide emulsion (iodide content: 6 mol %, average particle size: 0.7μ), silver coated amount: | 0.014 mol/m$^2$ |
| Sensitizing Dye VIII | $4.5 \times 10^{-4}$ mol per mol of silver |
| Coupler 8 | 0.25 mol per mol of silver |
| Coupler 9 | 0.002 mol per mol of silver |
| Tricresyl phosphate | 0.5 g per g of Couplers |

Tenth Layer: Second Blue-Sensitive Emulsion Layer

| | |
|---|---|
| A silver iodobromide emulsion (iodide content: 8 mol %, average particle size: 1.2μ), silver coated amount: | 0.010 mol/m$^2$ |
| Sensitizing Dye VIII | $3.0 \times 10^{-4}$ mol per mol of silver |
| Coupler 8 | 0.06 mol per mol of silver |
| Tricresyl phosphate | 0.5 g per g of Couplers |

Eleventh Layer: First Protective Layer

A gelatin layer containing a silver iodobromide emulsion (iodide content: 1 mol %, average particle size: 0.07μ) (silver coated amount: 0.5 g/m$^2$) and an emulsified dispersion of Ultraviolet Light Absorbing Agents UV-1 and UV-2 and tricresyl phosphate.

Twelfth Layer: Second Protective Layer

A gelatin layer containing polymethyl methacrylate par-

-continued

| |
|---|
| ticles (having a diameter of about 1.5μ) |

The couplers as shown in each layer were employed by dissolving them in the solvent having a high boiling point as specifically described above and ethyl acetate by heating and mixing the resulting solution with a 10% aqueous solution of gelatin containing sodium p-dodecylbenzenesulfonate as an emulsifier and emulsified using a colloid mill.

Gelatin Hardener H-1 and a surfaçe active agent were incorporated into each of the layers in addition to the above-described components.

The compounds used for preparing the samples are as follows:

Coupler 1

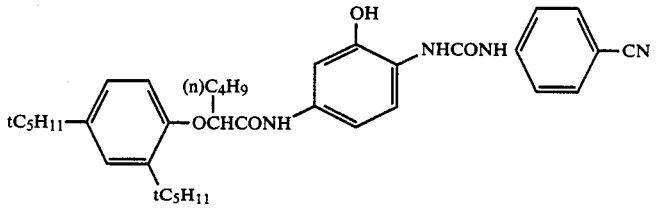

Coupler 2

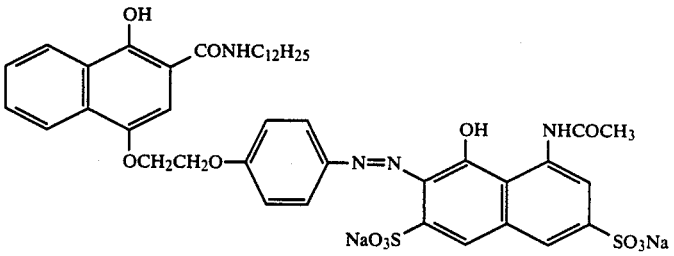

Coupler 3

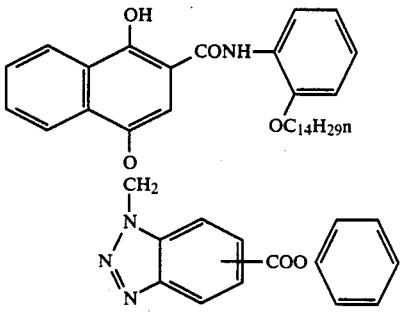

Coupler 4

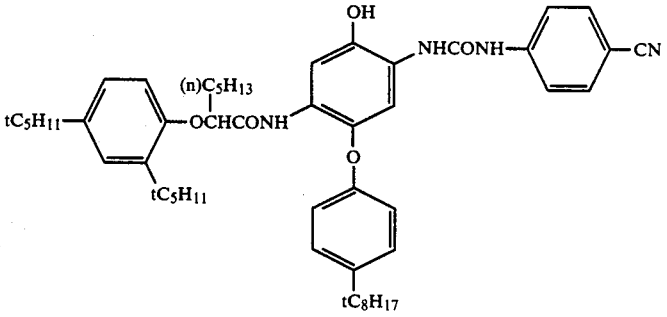

Coupler 5

-continued
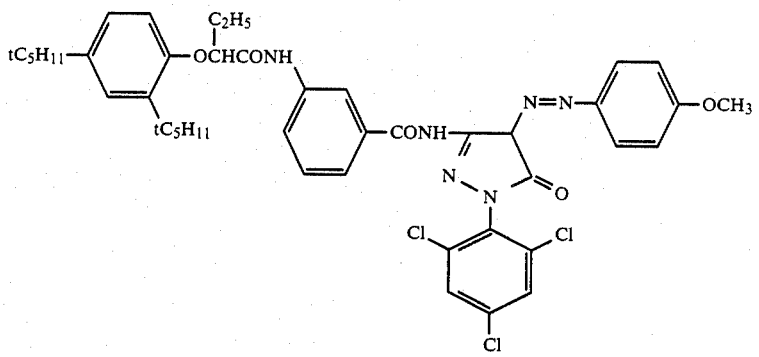
Coupler 6
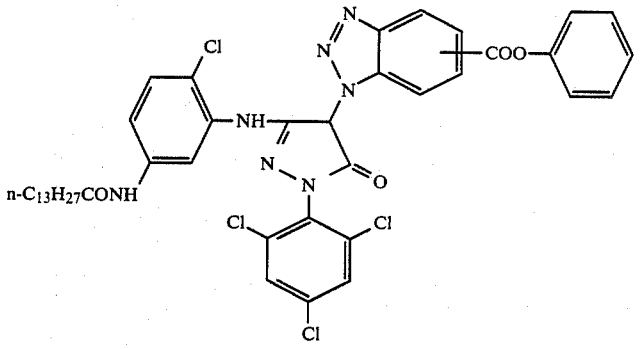
Coupler 8
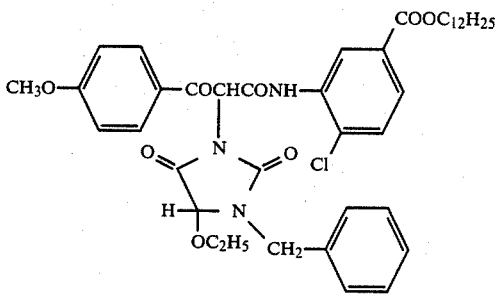
Coupler 9
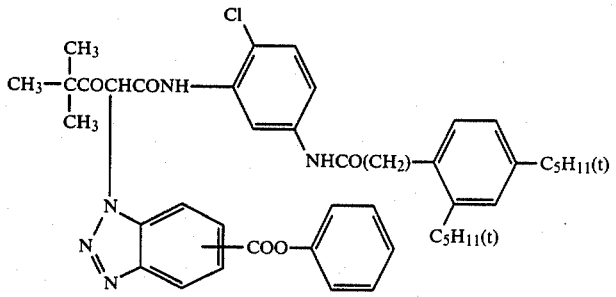
Ultraviolet Light Absorbing Agent UV-1
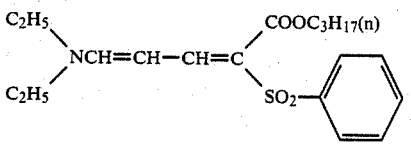
Ultraviolet Light Absorbing Agent UV-2

-continued
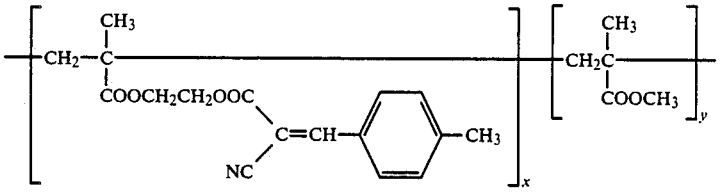
x/y = 7/3 (weight ratio)
Gelatin Hardener H-1
$CH_2{=}CHSO_2CH_2CONHCH_2CH_2NHCOCH_2SO_2CH{=}CH_2$
Sensitizing Dye I
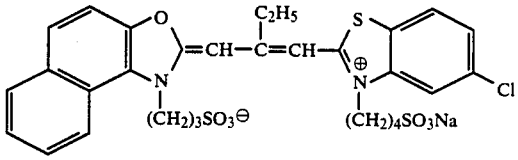
Sensitizing Dye II
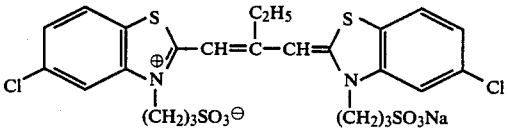
Sensitizing Dye III
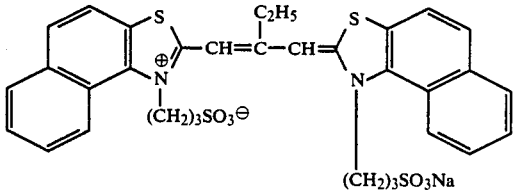
Sensitizing Dye IV
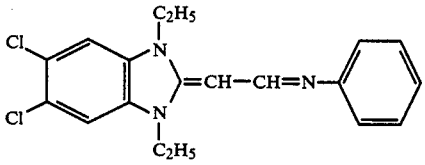
Sensitizing Dye V
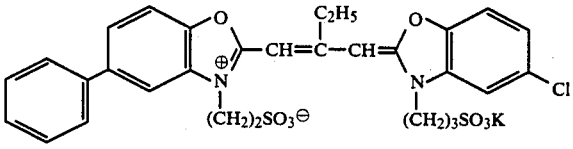
Sensitizing Dye VI
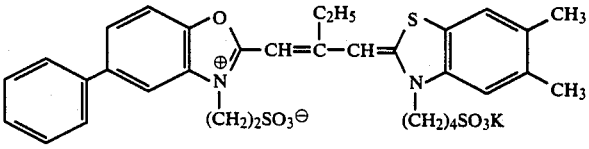
Sensitizing Dye VII
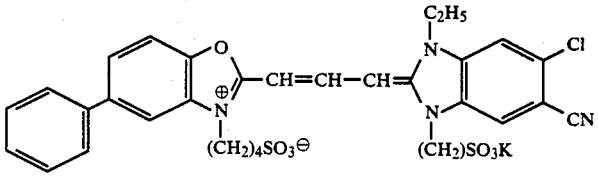
Sensitizing Dye VIII -continued

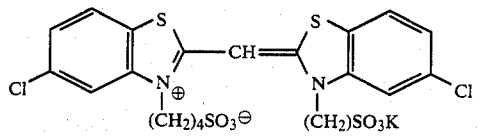

These color photographic materials were exposed to light in an exposure amount of 25 CMS using a tungsten light source and a filter to adjust the color temperature to 4,800° K. and then subjected to development processing at 38° C. according to the following processing steps.

| Processing Step | Time |
|---|---|
| Color development | 3 min 15 sec |
| Bleaching | 2 min |
| Bleach-Fixing | 3 min 15 sec |
| Washing with water | 3 min 15 sec |
| Stabilizing | 1 min 05 sec |

The processing solutions used in the color development processing had the following compositions:

| Color Developing Solution | |
|---|---|
| Diethylenetriaminepentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N—Ethyl-N—β-hydroxyethylamino)-2-methylaniline Sulfate | 4.5 g |
| Water to make | 1.0 liter |
| | pH 10.0 |
| **Bleaching Solution** | |
| Iron (III) Ammonium Ethylenediamine-tetraacetate | 120.0 g |
| Disodium Ethylenediaminetetraacetate | 10.0 g |
| Ammonium Bromide | 100.0 g |
| Ammonium Nitrate | 10.0 g |
| Aqueous Ammonia (28%) | 17.0 ml |
| Water to make | 1.0 liter |
| | pH 6.5 |
| **Bleach-Fixing Solution** | |
| Iron (III) Ammonium Ethylenediamine-tetraacetate | 50.0 g |
| Disodium Ethylenediaminetetraacetate | 10.0 g |
| Sodium Sulfite | 15.0 g |
| Ammonium Thiosulfate (70% aq. soln.) | 250.0 g |
| Aqueous Ammonia (28%) | 7.0 ml |
| Water to make | 1.0 liter |
| | pH 7.3 |
| **Stabilizing Solution** | |
| Formalin (40%) | 2.0 ml |
| Polyoxyethylene-p-monononylphenylether (average degree of polymerization = about 10) | 0.3 g |
| Water to make | 1.0 liter |

Each sample thus processed was preserved under the conditions of 80° C. and 20% RH (relative humidity) for 2 weeks and the change in magenta stain (ΔDG min) of the sample just after processing and the sample after the preservation was determined. The results obtained are shown in Table 1 below. In Table 1, the mark "+" indicates the increase in optical density after the preservation as compared with just after the processing.

TABLE 1

| Sample No. | Coupler 7 | ΔDG min | Remarks |
|---|---|---|---|
| 101 | Comparative Coupler A | +0.08 | Comparison |
| 102 | Comparative Coupler B | +0.09 | Comparision |
| 103 | M-39 | ±0 | Present Invention |
| 104 | M-40 | ±0 | Present Invention |
| 105 | M-4 | +0.01 | Present Invention |
| 106 | M-78 | +0.01 | Present Invention |
| 107 | M-18 | +0.03 | Present Invention |
| 108 | M-29 | +0.03 | Present Invention |
| 109 | M-72 | +0.03 | Present Invention |
| 110 | M-70 | +0.04 | Present Invention |
| 111 | M-74 | +0.04 | Present Invention |

Comparative Coupler A:

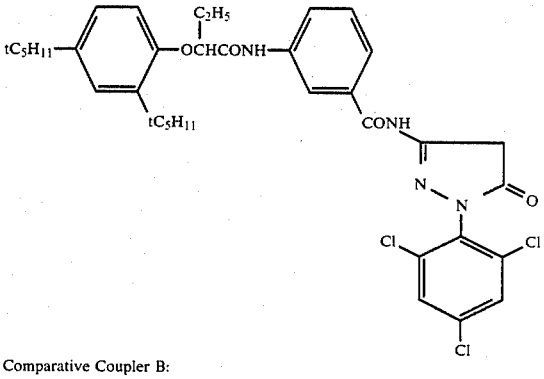

Comparative Coupler B:

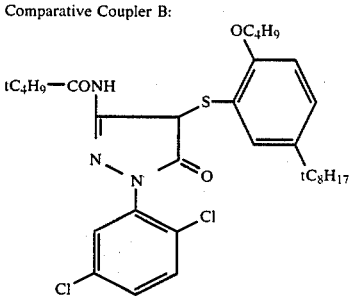

As is apparent from the results shown in Table 1, it is illustrated that according to the method of the present invention in which the specific magenta couplers are employed, the occurrence of magenta stain is suppressed in comparison with the cases wherein the comparative couplers are used in spite of using a shorter development processing time than used in the conventional method.

EXAMPLE 2

The same procedure as described in Example 1 was conducted using Samples 101 to 111 except that Bleach Accelerator (1) or (2) described below was added to the bleaching solution described in Example 1 in an amount of $1\times10^{-2}$ mol per liter and the bleaching time was changed to 1 minute. The changes in magenta strain were determined. The results obtained are shown in Table 2 below.

TABLE 2

| Sample No. | Coupler 7 | Δ DG min Bleach Accelerator (1) | Δ DG min Bleach Accelerator (2) | Remarks |
|---|---|---|---|---|
| 101 | Comparative Coupler A | +0.07 | +0.08 | Comparison |
| 102 | Comparative Coupler B | +0.08 | +0.09 | Comparison |
| 103 | M-39 | ±0 | +0.01 | Present Invention |
| 104 | M-40 | ±0 | ±0 | Present Invention |
| 105 | M-4 | +0.01 | +0.01 | Present Invention |
| 106 | M-78 | +0.01 | +0.02 | Present Invention |
| 107 | M-18 | +0.01 | +0.01 | Present Invention |
| 108 | M-29 | +0.03 | +0.03 | Present Invention |
| 109 | M-72 | +0.04 | +0.03 | Present Invention |
| 110 | M-70 | +0.04 | +0.04 | Present Invention |
| 111 | M-74 | +0.03 | +0.03 | Present Invention |

Bleach Accelerator (1):

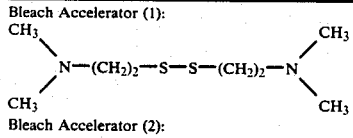

Bleach Accelerator (2):

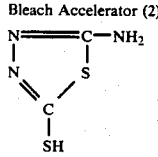

It is illustrated that in each sample desilveration is carried out to a level sufficient for practical use (5 $\mu g/m^2$ or less) in spite of a remarkable shortening of the processing time for the desilvering step.

Further, as is apparent from the results shown in Table 2 above, the effect of the present invention that the occurrence of magenta stain is suppressed is achieved in the cases wherein the bleach accelerator is added to the bleaching bath.

EXAMPLE 3

The same procedure as described in Example 1 was conducted except using the same amount of iron (III) ammonium diethylenetriaminepentaacetate in place of iron (III) ammonium ethylenediaminetetraacetate contained in the bleaching bath and the bleach-fixing bath. Similar results as were obtained in Example 1 were obtained.

While the invention has been described in detail and with reference to specific embodiments thereof, it will be apparent to one skilled in the art that various changes and modifications can be made therein without departing from the spirit and scope thereof.

What is claimed is:

1. A method of forming an image comprising, after color development of an exposed silver halide color photographic material, processing the developed silver halide color photographic material with a bath having a bleaching ability and with, a bath having a bleach-fixing ability, which is provided behind said bath having a bleaching ability, and then washing the processed silver halide color photographic material with water, wherein the silver halide photographic material comprises a support having coated thereon at least one silver halide emulsion layer and at least one pyrazoloazole type magenta coupler represented by the following general formula (A):

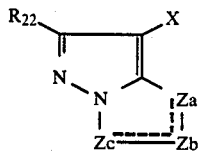

(A)

wherein $R_{22}$ represents a hydrogen atom or a substituent; X represents a group capable of being split off upon a coupling reaction with an oxidation product of an aromatic primary amine developing agent; Za, Zb, and Zc each represents a methine group, a substituted methine group, =N— or —NH—, one of the Za-Zb bond and the Zb-Zc bond being a double bond and the other being a single bond; when the Zb-Zc bond is a carbon-carbon double bond, the Zb-Zc bond may be a part of a condensed aromatic ring; $R_{22}$ or X may also form a polymer including a dimer or more; and when Za, Zb or Zc is a substituted methine group, the substituted methine group may form a polymer including a dimer or more, and the water washing time is in the range of from 30 seconds to 2 minutes.

2. A method of forming an image as claimed in claim 1, wherein the pyrazoloazole type magenta coupler is a bis coupler, an oligomer coupler or a polymer coupler containing a coupler moiety represented by the general formula (A).

3. A method of forming an image as claimed in claim 2, wherein the polymer coupler is a homopolymer composed of a monomer having a coupler moiety represented by the general formula (A) or a copolymer composed of a monomer having a coupler moiety represented by the general formula (A), wherein the monomer has a vinyl group, and a non-color forming ethylenic monomer which does not undergo coupling with the oxidation product of an aromatic primary amine developing agent.

4. A method of forming an image as claimed in claim 1, wherein the pyrazoloazole type magenta coupler is a 1H-imidazo[1,2-b]pyrazole, a 1H-pyrazolo[1,5-b]pyrazole, a 1H-pyrazolo[1,5-b][1,2,4]triazole, a 1H-pyrazolo[1,5-d]tetrazole or a 1H-pyrazolo[1,5-a]benzimidazole.

5. A method of forming an image as claimed in claim 1, wherein the the pyrazoloazole type magenta coupler is represented by the following general formulae (A)-2, (A)-3, (A)-4, (A)-6 or (A)-7:

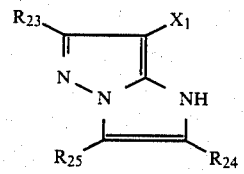
(A)-2

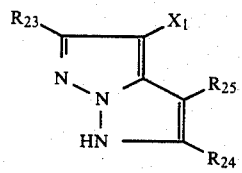
(A-3)

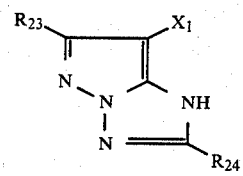
(A)-4

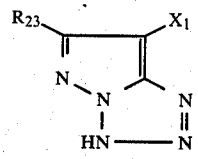
(A)-5

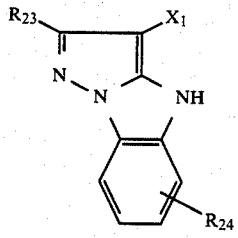
(A)-6

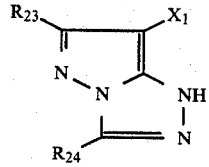
(A)-7 wherein $R_{23}$, $R_{24}$and $R_{25}$, which may be the same or different, each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; and $X_1$ represents a halogen atom, a carboxyl group or a group capable of being split off upon coupling which is bonded to the carbon atom at the coupling position through an oxygen atom, a nitrogen atom or a sulfur atom, or $R_{23}$, $R_{24}$, $R_{25}$ or $X_1$ may be a divalent group to form a bis coupler.

6. A method of forming an image as claimed in claim 5, wherein the pyrazoloazole type magenta coupler is a copolymer coupler in which the coupler moiety derived from the coupler represented by the general formulae (A)-2, (A)-3, (A)-4, (A)-5, (A)-6 or (A)-7 is present in a vinyl monomer, and $R_{23}$, $R_{24}$ or $R_{25}$ represents a chemical bond or a linking group, through which the coupler moiety is connected to the vinyl group.

7. A method of forming an image as claimed in claim 5, wherein the divalent group to form a bis coupler represented by $R_{23}$, $R_{24}$, $R_{25}$ or $X_1$ is a substituted or unsubstituted alkyl-ene group, a substituted or unsubstituted phenylene group or a group of the formula —NH-CO—$R_{26}$—CONH—, wherein $R_{26}$ represents a substituted or unsubstituted alkylene group or a substituted or unsubstituted phenylene group.

8. A method of forming an image as claimed in claim 6, wherein the linking group represented by $R_{23}$, $R_{24}$ or $R_{25}$ is a substituted or unsubstituted alkylene group, a substituted or unsubstituted phenylene group, —NH-CO—, —CONH—, —O—, —OCO—, an aralkylene group or a combination thereof.

9. A method of forming an image as claimed in claim 6, wherein the vinyl group may further have a substituent selected from a chlorine atom and a lower alkyl group having from 1 to 4 carbon atoms in addition to the coupler moiety.

10. A method of forming an image as claimed in claim 6, wherein the polymer coupler is a homopolymer.

11. A method of forming an image as claimed in claim 6, wherein the polymer coupler is a copolymer.

12. A method of forming an image as claimed in claim 6, wherein the polymer coupler is a copolymer containing a repeating unit derived from a non-color forming ethylenic monomer which does not couple with the oxidation product of an aromatic primary amine developing agent.

13. A method of forming an image as claimed in claim 12, wherein the non-color forming ethylenic monomer is an acrylic acid, an ester of acrylic acid, an ester of an acrylic acid, an amide of an acrylic acid, methylenebisacrylamide, a vinyl ester, acrylonitrile, methacrylonitrile, an aromatic vinyl compound, itaconic acid, citraconic acid, crotonic acid, vinylidene chloride, a vinylalkyl ether, maleic acid, maleic anhydride, an ester of maleic acid, N-vinyl-2-pyrolidone, n-vinylpyridine or 2- or 4-vinylpyridine.

14. A method of forming an image as claimed in claim 5, wherein the pyrazoloazole type magenta coupler is represented by the general formulae (A)-2, (A)-4 or (A)-7.

15. A method of forming an image as claimed in claim 5, wherein the pyrazoloazole type magenta coupler is represented by the general formula (A)-4.

16. A method of forming an image as claimed in claim 1, wherein the pyrazoloazole type magenta coupler is present in a silver halide emulsion layer or an adjacent layer thereto.

17. A method of forming an image as claimed in claim 1, wherein an amount of coupler is from 0.01 $g/m^2$ to 2.0 $g/m^2$.

18. A method of forming an image as claimed in claim 16, wherein the silver halide emulsion layer is a green-sensitive silver halide emulsion layer.

19. A method of forming an image as claimed in claim 1, wherein the bath having a bleaching ability is a bleaching bath which contains a bleaching component and has an ability of bleaching developed silver.

20. A method of forming an image as claimed in claim 1, wherein the bath having a bleaching ability is a bleaching bath capable of bleaching at least more than ½ of the maximum amount of developed silver contained in the color photographic light-sensitive material.

21. A method of forming an image as claimed in claim 20, wherein the bleaching bath is a bath which desilvers only less than ½ of the total coating amount of silver contained in the color photographic light-sensitive material.

22. A method of forming an image as claimed in claim 1, wherein the bath having a bleach-fixing ability is a bleach-fixing bath which is capable of bleaching the remaining developed silver which is not bleached in the bath having a bleaching ability and desilvering it together with the remaining silver salt which is not desilvered in the bath having a bleaching ability and which contains a bleaching agent in an amount of 0.05 mol or more per liter.

23. A method of forming an image as claimed in claim 1, wherein the bath having a bleach-fixing ability is a bleach-fixing bath which bleaches only less than ½ of the maximum amount of developed silver contained in the color photographic light-sensitive water.

24. A method of forming an image as claimed in claim 23, wherein the bleach-fixing bath is a bath capable of desilvering at least more than ½ of the total coating amount of silver contained in the color photographic light-sensitive material.

25. A method of forming an image as claimed in claim 1, wherein an overflow solution of the bath having a bleaching ability is introduced directly into the bath having a bleach-fixing ability.

26. A method of forming an image as claimed in claim 1, wherein a bleaching agent contained in the bath having a bleaching ability and the bath having a bleach-fixing ability is an aminopolycarboxylic acid ferric ion complex salt which is a complex of ferric ion and an aminopolycarboxylic acid or a salt thereof.

27. A method of forming an image as claimed in claim 26, wherein the aminopolycarboxylic acid or salt thereof is ethylenediaminetetraacetic acid, disodium ethylenediaminetetraacetate, diammonium ethylenediaminetetraacetate, diethylenetriaminepentaacetic acid or cyclohexanediaminetetraacetic acid.

28. A method of forming an image as claimed in claim 1, wherein the bath having a bleaching ability or the bath having a bleach-fixing ability further contains a water-soluble bromide.

29. A method of forming an image claimed in claim 1, wherein the bath having a bleaching ability or the bath having a bleach-fixing ability further contains a bleach accelerator.

30. A method of forming an image as claimed in claim 29, wherein the bleach accelerator is a compound represented by the following general formulae (I) or (II):

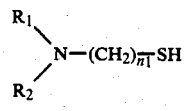
(I)

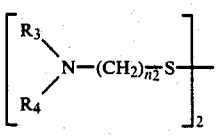
(II)

wherein $R_1$, $R_2$, $R_3$, $R_4$, which may be the same or different, each represents a hydrogen atom, a substituted or unsubstituted lower alkyl group or an acyl group, or $R_1$ and $R_2$ or $R_3$ and $R_4$ may be bonded to each other to form a ring; and $n_1$ and $n_2$ each represents an integer from 1 to 3.

31. A method of forming an image as claimed in claim 29, wherein the bleach accelerator is a compound represented by the following formulae (III), (IV) or (V):

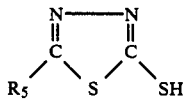
(III)

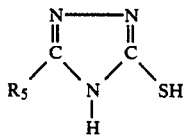
(IV)

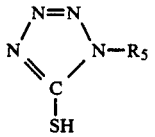
(V)

wherein $R_5$ represents a hydrogen atom, a halogen atom, an amino group, a substituted or unsubstituted lower alkyl group or an amino group substituted with an alkyl group.

32. A method of forming an image as claimed in claim 29, wherein the bleach accelerator is a compound represented by the following general formula (VI):

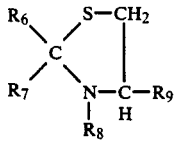
(VI)

wherein $R_6$ and $R_7$, which may be the same or different, each represents a hydrogen atom, a substituted or unsubstituted alkyl group, a substituted or unsubstituted phenyl group or a substituted or unsubstituted heterocyclic group; $R_8$ represents a hydrogen atom or a substituted or unsubstituted lower alkyl group; and $R_9$ represents a hydrogen atom or a carboxyl group.

33. A method of forming an image as claimed in claim 29, wherein the bleach accelerator is a compound represented by the following general formula (VII):

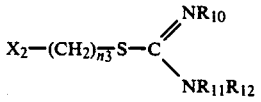
(VII)

wherein $R_{10}$, $R_{11}$ and $R_{12}$, which may be the same or different, each represents a hydrogen atom or a lower alkyl group, or $R_{10}$ and $R_{11}$ or $R_{12}$ may be bonded to each other to form a ring; $X_2$ represents a substituted or unsubstituted amino group, a sulfo group or a carboxyl group; and n represents an integer of from 1 to 4.

34. A method of forming an image as claimed in claim 29, wherein the bleach accelerator is a compound represented by the following general formula (VIII):

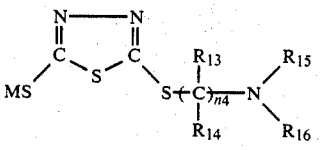

(VIII)

wherein $R_{13}$ and $R_{14}$, which may be the same or different, each represents a hydrogen atom, a hydroxyl group, a substituted or unsubstituted amino group, a carboxyl group, a sulfo group or a substituted or unsubstituted alkyl group; $R_{15}$ and $R_{16}$, which may be the same or different, each represents a hydrogen atom, a substituted or unsubstituted alkyl group or a substituted or unsubstituted acyl group, or $R_{15}$ and $R_{16}$ may be bonded to each other to form a ring; M represents a hydrogen atom, an alkali metal atom or an ammonium group; and $n_4$ represents an integer from 2 to 5.

35. A method of forming an image as claimed in claim 29, wherein the bleach accelerator is a compound represented by the following general formula (IX):

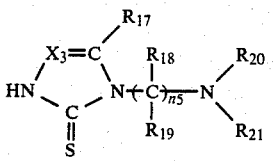

(IX)

wherein $X_3$ represents N or C—R, in which R has the same meanings as in $R_{17}$, $R_{18}$ and $R_{19}$ as defined hereinbelow; $R_{17}$, $R_{18}$ and $R_{19}$, which may be the same or different, each represents a hydrogen atom, a halogen atom, an amino group, a hydroxyl group, a carboxyl group, a sulfo group or a substituted or unsubstituted alkyl group; $R_{20}$ and $R_{21}$, which may be the same or different, each represents a hydrogen atom, a substituted or unsubstituted alkyl group or a substituted or unsubstituted acyl group, or $R_{20}$ and $R_{21}$ may be bonded to each other to form a ring, provided that both $R_{20}$ and $R_{21}$ are not hydrogen atoms at the same time; and $n_5$ represents an integer of from 0 to 5.

36. A method of forming an image as claimed in claim 1, wherein the color development is carried out using an alkaline aqueous solution containing an aromatic primary amine color developing agent.

37. A method of forming an image as claimed in claim 16, wherein the pyrazoloazole type magenta coupler is present in a green-sensitive silver halide emulsion layer.

38. A method of forming an image as claimed in claim 37, wherein the silver halide color photographic material further contains at least one blue-sensitive silver halide emulsion layer and at least one red-sensitive silver halide emulsion layer.

39. A method of forming an image as claimed in claim 38, wherein at least one of the blue-sensitive silver halide emulsion layers contains a yellow dye forming coupler and at least one of the red-sensitive silver halide emulsion layers contains a cyan dye forming coupler.

40. A method of forming an image as claimed in claim 39, wherein the yellow dye forming coupler is selected from hydrophobic α-pivaloylacetanilide type couplers and hydrophobic α-benzoylacetanilide type couplers.

41. A method of forming an image as claimed in claim 39, wherein the cyan dye forming coupler is selected from hydrophobic naphthol type couplers and hydrophobic phenol type couplers.

* * * * *